United States Patent [19]

Heisler

[11] 4,002,093

[45] Jan. 11, 1977

[54] PUNCH PRESS TRANSFER MECHANISM

[76] Inventor: Harold Heisler, Old Naperville Road, Rte. 3, Plainfield, Ill. 60544

[22] Filed: Sept. 19, 1975

[21] Appl. No.: 615,056

[52] U.S. Cl. ..... 83/154; 72/422; 83/255; 83/405; 214/1 BC

[51] Int. Cl.[2] ..... B26D 7/06; B26D 5/22

[58] Field of Search ..... 83/81, 82, 151, 153, 83/154, 255, 405; 214/1 BB, 1 BC; 72/405, 422

[56] References Cited

UNITED STATES PATENTS 3,080,840 3/1963 DeMan ..... 83/153 X

*Primary Examiner*—Robert Louis Spruill
*Attorney, Agent, or Firm*—Norman H. Gerlach

[57] ABSTRACT

The provision in a conventional punch press of a cyclicly-operable transfer mechanism which is adapted to be bolted to the stationary die shoe of the press in between successive forming stations and has associated with it a pair of blank-gripping jaws which travel generally in web line fashion between first and second stations for blank-transferring purposes while at the same time rotating so that each blank is reversed from end to end upon completion of the transfer operation. During the transfer, the jaws swing or revolve in a circular path about a vertical axis so that directional reversal of the jaws accounts for a major portion of the blank displacement. Additional web line jaw displacement takes place at the first forming station in order to bring the jaws while in an open position into straddling relationship with the leading edge of a blank prior to gripping thereof and similar web line jaw displacement takes place at the second forming station in order to withdraw the open jaws from the transferred blank after release thereof. Components of vertical jaw movement during the transfer take place, if required, for the purpose of lifting the blank from the plane of the web and compensating for differences in elevation of the blank at the two forming stations.

26 Claims, 22 Drawing Figures

PUNCH PRESS TRANSFER MECHANISM

The present invention generally relates to punch press transfer mechanisms and has particular reference to a particular transfer mechanism by means of which a pre-cut blank issuing from a continuous web at a first forming station and deposited thereat with its direction reversed in end-to-end fashion.

There is currently in use a wide variety of punch press transfer mechanisms by means of which a blank, issuing from a web at a first forming station, is transferred bodily to a second forming station where further work is performed upon the blank, the transfer taking place solely under power which is supplied by the movement of the operating parts of the associated punch press. A transfer mechanism of such type invariably involves the in-line shifting of the blank, i.e., causing the blank to travel in the direction of extent of the web, without changing the orientation of the blank so that when the blank is released and deposited at the second forming station it assumes the same orientation that it assumed at the time it was contained within the web at the first forming station. Ordinarily, where subsequent forming operations at a second forming station dictate that the blank shall be otherwise oriented, as, for example, turned end for end or at a right angle to the direction of extent of the web, either the blank is manually handled or its transfer is accomplished by complicated blank-handling devices which are separate from those which withdrew the blank from the web at the first forming station and are not necessarily under the control of the operating parts of the associated punch press ram.

In connection with such a conventional transfer mechanism involving linear in-line or web line shifting of the blank from one forming station to the next, the mechanism normally includes a carriage or slide which reciprocates through a stroke corresponding to the span between successive stations, together with blank-gripping fingers or jaws for gripping and releasing the blank at the time it initially is engaged and at the time it is released. Such fingers or jaws engage one longitudinal edge portion of the blank and, therefore, it is necessary that the full stroke of the carriage be such that the latter completely enters the first station to receive the blank, that it traverses the distance between the two stations, and that it completely enters the second station to deposit the blank thereat. With a press-driven mechanism of this type, means are provided for shifting the blank-engaging jaws transversely of the web direction to bring such jaws into register and gripping engagement with the adjacent longitudinal edge portion of the blank when the carriage of the punch press is within the first forming station, and means also are provided for reversely shifting the jaws transversely of the web to release and move away from the blank when the carriage is within the second forming station.

Transfer mechanisms of the character or type briefly outlined above are relatively complicated and, moreover, they are bulky and require considerable space. The comparatively large displacement of the carrier of a punch press in moving from one forming station and back again involves the use of cams which have an appreciable throw, and the mechanism which is required for shifting the blank-engaging fingers or jaws at the proper time when the carriage is in one forming station or the other, as well as for moving the jaws to engage or release the blank, is of an involved nature and, therefore, extremely costly.

The particular punch press transfer mechanism of the present invention is basically different from a conventional transfer mechanism which conducts the blank linearly from one forming station to another without altering its direction or orientation in that it makes provision for rotating the blank throughout an angle of 180° while the blank is being delivered from one forming station to another. Toward this end, the invention contemplates the provision of a blank-transferring carriage having mounted thereon a pair of blank-gripping fingers or jaws which are rotatable bodily throughout an angle of 180°. Such blank-engaging jaws are designed to grip the leading edge portion of the blank at a first forming station and, therefore, it is not necessary that the carriage of the transfer mechanism move completely into such station. It is only necessary that such carriage approach the first forming station to the point where the jaws register with the leading edge portion of the blank. At this point, the jaws are caused to close and grip the leading edge portion of the blank, after which the blank-transferring carriage is elevated a slight distance in order to lift the thus gripped blank from the plane of the web which originally contained the blank. Thereafter, the carriage is moved generally horizontally toward the second forming station while at the same time the jaws are rotated in order to swing the blank through an angle of 180° about the vertical axis of rotation of the jaws. This end-to-end reversal of the blank, in itself, effects a large component of linear displacement of the blank so that the only in-line displacement of the blank-transferring carriage which is required to produce a complete effective transfer of the blank from the first forming station to the second forming station is a small carriage movement sufficient to position the blank in accurate vertical register with whatever forming instrumentalities are provided at the second forming station. The rotation of the jaws and consequent reversal of the position of the blank produces a major portion of the required transfer distance, the only additional movement of the blank being effected by linear shifting of the carriage to a comparatively small extent in order to cause the open jaws to move clear of the blank at the second forming station before reverse rotation of the jaws is effected during return of the jaws to the first forming station, and a second linear shifting of the carriage another small amount in order to cause the open jaws to move into straddling relation with another blank at the first forming station. The vertical components of motion of which the blank-transferring carriage and its associated rotatable jaws are capable may be varied according to the nature of the forming devices which are employed at the first and second forming stations. In addition to the vertical movement necessary to lift the blank from the web which is fed to the associated punch press before it can be transferred, additional components of vertical motion may be imparted to the carriage in order to compensate for differences of elevation which may be required at the two forming stations. Thus, if desired, the blank may be released at the second forming station at a level higher than the level of the web, at a level precisely coincident with the plane of the web, or, under certain circumstances, at a level below the plane of the web. Irrespective of the required vertical movements which are imparted to the blank-transferring carriage and the jaws which are supported thereby, the essential features of the invention are at all times preserved.

The provision of a transfer mechanism such as has briefly been outlined above constitutes the principal object of the present invention.

Briefly, in carrying out this object, the transfer mechanism of the present invention embodies three principal composite assemblies or components, one of which is in the form of a centerpost component which is fixedly secured to the stationary die shoe. Associated with such centerpost component is a cam component which is fixedly secured to the punch holder of the associated punch press and, consequently, moves vertically therewith during operation of the punch press. A jaw-supporting carriage component of cage-like construction encompasses the centerpost and cam components in confining relationship, allows for vertical shifting of the cam component on the centerpost component, as well as for relative vertical shifting of itself upon both the centerpost and the cam components, and also allows for limited in-line or web line shifting, i.e., sidewise shifting with respect to the die shoe of the press. The cam component is formed with a plurality of cam grooves or tracks while various cam follow rollers are associated with such cam tracks and are carried by the centerpost component, the cam and follower arrangement being such that as the vertically movable part (ram) of the punch press reciprocates, the cam component makes positive up and down strokes commensurate with the amplitude of ram reciprocation, the centerpost component remains fixed, and the carriage component, which in a sense is a floating component, makes the required up and down movement, as well as the required in-line right and left shifting movements as previously described. More specifically, two of the cam tracks on the cam component cooperate with each other to control the right and left shifting movements of the blank-transferring and jaw-supporting carriage; a third cam track controls the vertical up and down motions of the carriage, a fourth cam track controls the rotary motion or oscillation of the blank-engaging jaws; and a pair of cam protuberances on the cam component controls the opening and closing movements of the blank-engaging jaws, as well as the locking and unlocking of such jaws in their open and closed positions.

An advantageous feature of the present invention resides in the fact that the cage-like jaw-supporting carriage component closely encompasses the two other components, namely, the cam and centerpost components, so that the transfer mechanism, considered as a whole, is extremely compact. Furthermore, since the carriage component is capable of only a small limited lateral motion, the space required for it on the upper surface of the die shoe of the associated punch press is relatively small. The attainment of this feature constitutes a further important object of the present invention.

The provision of a transfer mechanism which is comprised of a minimum number of parts, particularly relatively moving parts, and, therefore, is unlikely to get out of order; one which, because of the close fitting of its relatively movable parts and the sturdiness thereof, is rugged and durable and, therefore, will withstand rough usage; one which is smooth and silent in its operation; one which may be manufactured at a relatively low cost; one which is capable of ease of assembly and dismantlement, thereby further contributing to low cost, as well as facilitating inspection of parts for purposes of replacement or repair; and one which, otherwise, is well adapted to perform the services required of it, are further desirable features which have been borne in mind in the production and development of the present invention.

Other objects and advantages of the invention, not at this time enumerated, will readily suggest themselves as the nature of the invention is better understood from a consideration of the following detailed description.

The invention consists in the several novel features which are hereinafter set forth and are more particularly defined by the claims at the conclusion hereof.

In the accompanying ten sheets of drawings forming a part of this specification, one illustrative embodiment of the invention is shown.

Figure 21:
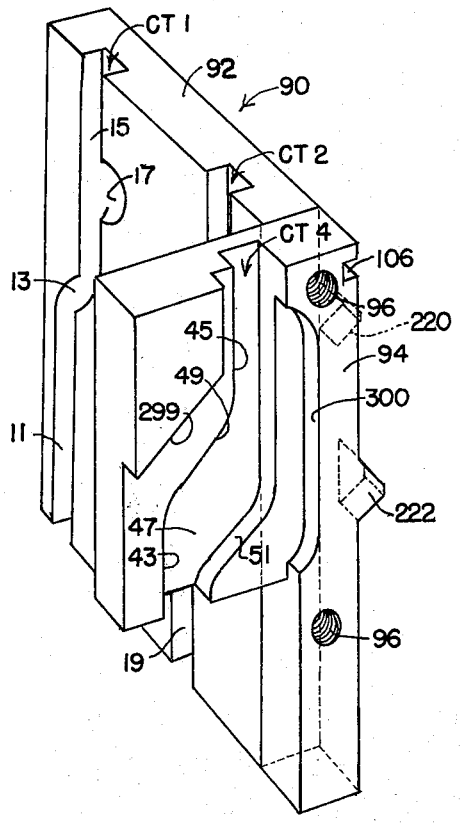
Figure 22:
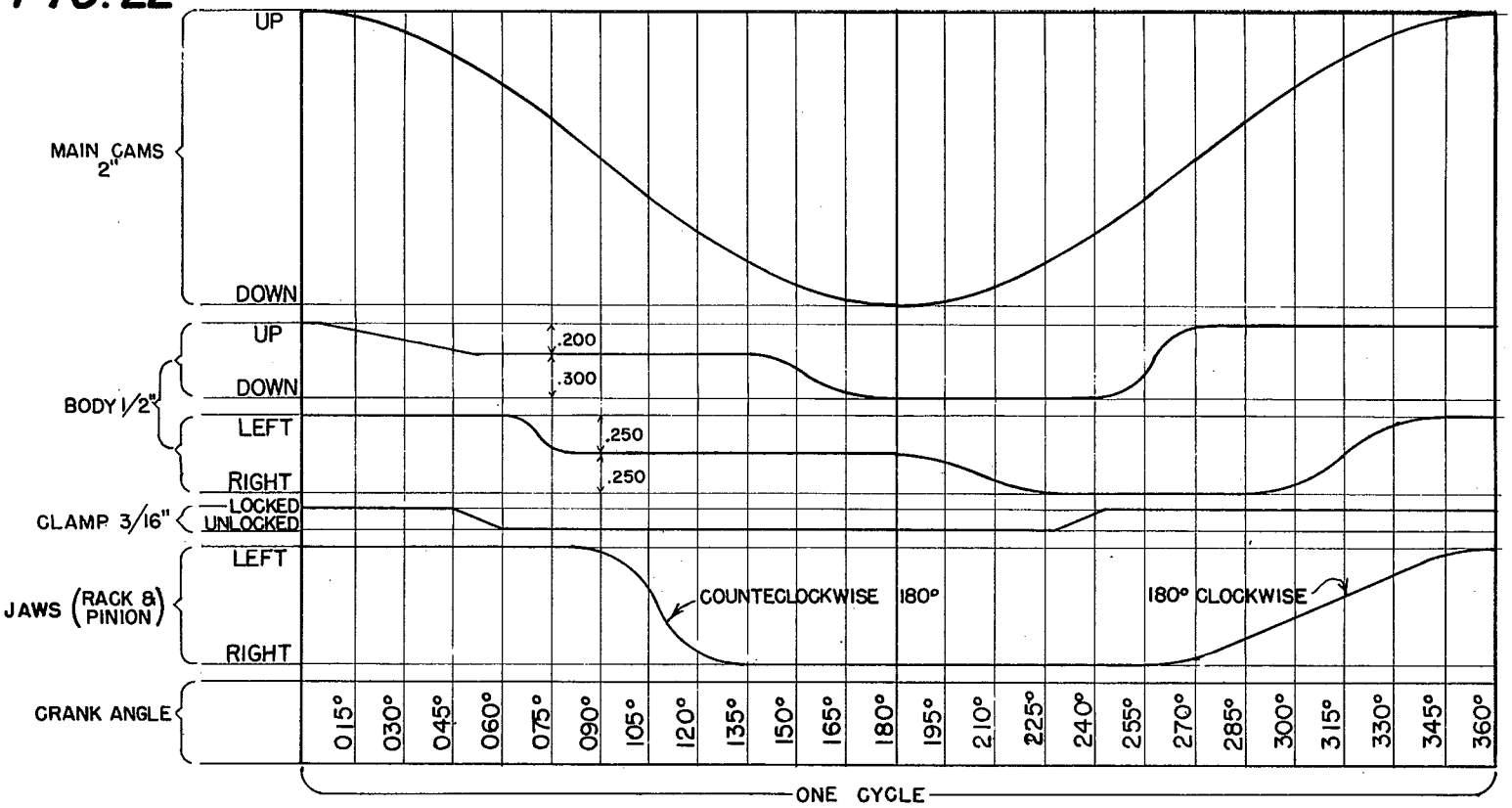

FIG. 21 is a left perspective view of another cam plate which is employed in connection with the invention, such view illustrating schematically the relative movements between a cam track which is associated therewith and its associated cam follower; and FIG. 22 is a timing chart or diagram of the transfer mechanism, illustrating the motions of the main body of the transfer mechanism, certain cam tracks, a clamping device, and a rack and pinion device, all related to the crank angle of the punch press to which the transfer mechanism is applied.

Figure 2:
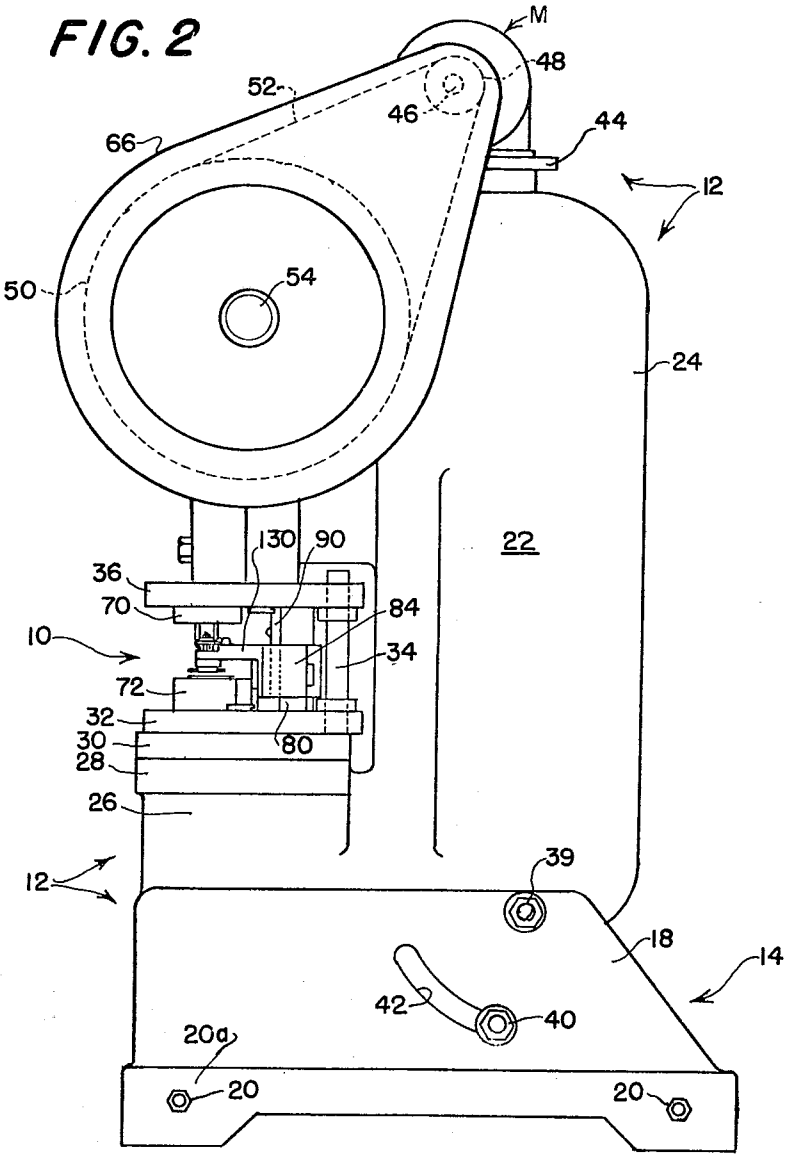
FIG. 2 is a side elevational view of the structure which is shown in FIG. 1.
Figure 1:
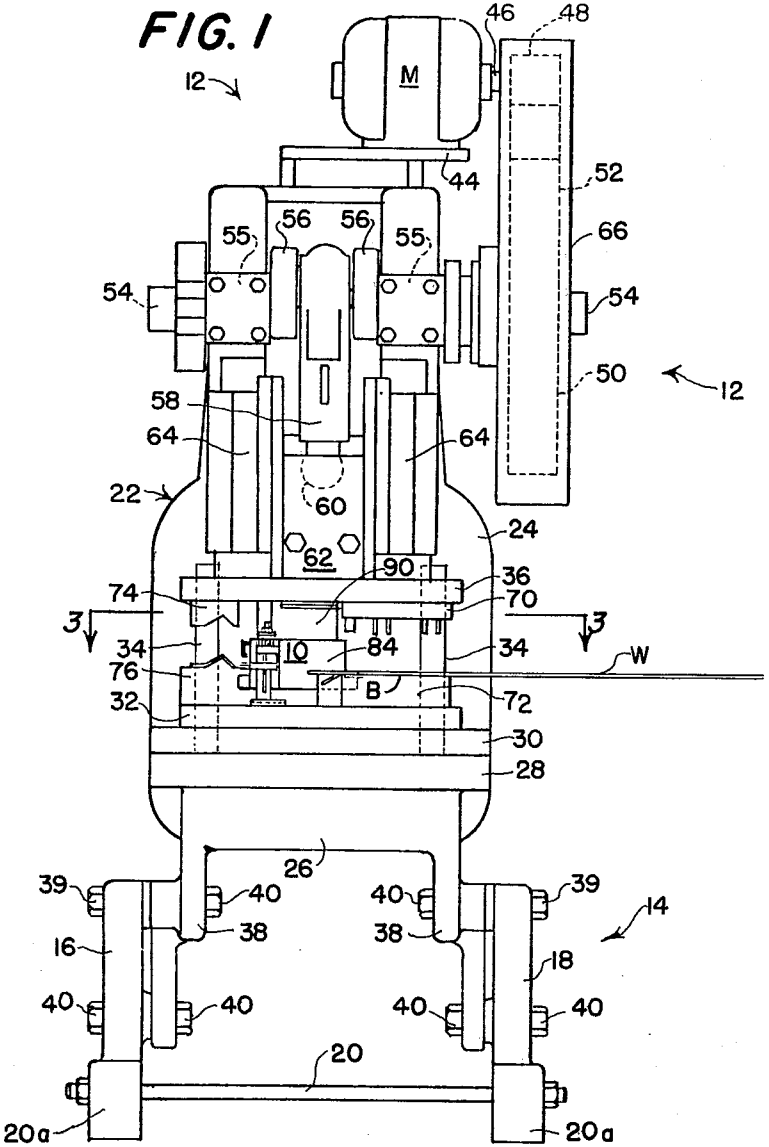
FIG. 1 is a front elevational view of a conventional open back inclinable punch press, showing the transfer mechanism of the present invention operatively installed therein.

Referring now to the drawings in detail and in particular to FIGS. 1 and 2, a transfer mechanism embodying the principles of the present invention is designated in its entirety by the reference numeral 10 and it is shown as being operatively installed in a more or less conventional punch press 12 of the open back inclinable type, such particular type being commonly referred to as "OBI." The details of the punch press 12 have not been fully disclosed herein, only the outline of the principal parts of the press being shown in somewhat schematic fashion.

The punch press 12 which has been selected as an environment for the transfer mechanism 10 involves in its general organization the usual punch press base 14 which is comprised of spaced apart left and right side members 16 and 18. The latter extend vertically and are fixedly connected together by a plurality of horizontally extending struts 20 the ends of which are suitably attached to feet-like structures 20*a* on the lower portions of the side members 16 and 18. In addition to the base 14, the punch press 12 comprises a frame 22 (see FIG. 2) which is pivotally mounted on the base 14, such frame being generally of L-shape design and including a vertical frame part 24 and a lower horizontal frame part 26. The latter constitutes the usual work-supporting portion of the press and provides a horizontal bed 28. Fixedly secured to the bed 28 is a plate-like bolster 30 which, in turn, has fixedly connected thereto the usual die shoe 32, suitable fastening screws or bolts (not shown) being provided for fastening these parts together in a manner well known in the art.

Two leader pins 34 project vertically and upwardly from the die shoe 32 near the rear edge portion of the latter and serve as guide means for the vertically shiftable punch holder 36 which is ordinarily associated with an OBI punch press of the character under consideration.

Still referring to FIGS. 1 and 2 and particularly to FIG. 1, the lower horizontal frame part 26 of the punch press frame 22 is formed with depending side portions 38 which are pivoted by means of horizontally extending bolts 39 to the upper rear corner portions of the side members 16 and 18 of the punch press base 14. A pair of stud and nut clamping devices 40, one for each side portion 38, is effective in connection with respective arcuate slots 42 in said side members 16 and 18 releasably to clamp the frame part 26 of the punch press frame 22 in desired positions of angularity as is common in connection with an inclinable punch press of the character under consideration.

Suitably mounted on the upper end portion of the vertical frame part 24 of the punch press frame 22 is a horizontally extending platform 44 which supports an electric motor M having associated therewith a drive shaft 46. The latter has fixedly mounted thereon a pulley 48 which is drivingly connected to a punch press flywheel 50 by means of an endless belt 52. The flywheel 50 is mounted in driving relationship on one end of a horizontal crank shaft 54 which is rotatably journalled in bearing assemblies 55 on the front portion of the vertical part 26 of the punch press frame 22. An eccentric or crank 56 on the central portion of the crank shaft 54 is rotatably connected to the upper end of a vertically extending connecting rod 58 the lower end of which is operatively connected by means of a ball and socket joint 60 to a vertically travelling or reciprocating slide member or carriage 62. Two spaced apart upstanding guide members 64 straddle the carriage 62 and serve to guide the same in its vertical movements. A sheet metal protective guard 66 encompasses the pulley 48, the belt 52, and the flywheel 50 for safety reasons.

The general arrangement of the OBI punch press 12 thus far described is purely conventional and no claim is made herein to any novelty in it. As previously stated, the illustrated punch press 12 is one that has been selected for environmental purposes in connection with the particular transfer mechanism 10 which constitutes the present invention and will be presently described in detail and subsequently claimed.

The transfer mechanism 10 of the present invention is designed and adapted to be mounted on the die shoe 32 of the punch press 12 as clearly shown in FIGS. 1 and 2 of the drawings and, when so mounted, it assumes a position immediately beneath the vertically shiftable punch holder 36. The function or purpose of the transfer mechanism is to receive a punched blank B (see FIGS. 1 and 3) which is disposed at a first forming station FSl, has been severed from a continuous web of strip stock W issuing from a suitable source (not shown), and has been operated upon by the upper and lower relatively movable members 70 and 72 of a suitable die set, and thereafter to transfer such blank to a second forming station FS2 so that it may subsequently be operated upon by the upper and lower relatively movable members, 74 and 76, of another suitable set. During the transfer operation, the leading edge portion of the blank B is gripped between a pair of clamping jaws J (see FIGS. 3 to 6, inclusive, 8 and 9) and, by means of such jaws, the transfer of the blank is effected by rotating the jaws generally in a horizontal plane throughout an angle of 180° while at the same time displacing the blank laterally in the direction of web feed. Additionally, during the transfer operation, certain vertical movements of the jaws and the blank are effected in order to raise the blank initially from its nested position within the plane of the web W so that it will be free to swing throughout an angle of 180° immediately prior to placement thereof in the second forming station FS2, all in a manner and for purposes that will be made clear presently when the nature of the invention is better understood.

Referring now to FIGS. 3 to 9 of the drawings, the transfer mechanism 10 involves in its general organization three principal assemblies or components each of which is in the form of a composite assembly of parts. These three components include: (1) a fixed inner centerpost 80 which is of generally rectangular block-like design, is secured by screws 82 or the like (see particularly FIGS. 3, 4 and 9) to the die shoe 32 of the punch press 12 and, therefore, is a fixed or immovable member; (2) a composite, outer, two-part, jaw-supporting, frame-like body or carriage 84 which consists of a generally U-shaped frame member 86 and a back plate member 88 which is secured by screws 89 to the right and left side walls of the U-shaped frame member 86 as viewed in FIG. 3, thus establishing a closed loop-like structure in encompassing or surrounding relation with the fixed centerpost 80; and (3) a composite, two-part, L-shaped cam piece or member 90 (see FIGS. 3 to 6, inclusive and particularly FIG. 20) which consists of a first laterally extending, vertically disposed, rectangular cam plate 92 and a second cam plate 94 (see also FIGS. 10 to 21, inclusive), the two cam plates being secured together in edge-to-face relationship by fastening screws 96 and the entire composite cam piece 90 being capable of vertical up and down motions with respect to the block-like centerpost 80 which it adjoins, and also being capable of right and left sliding movement in unison with the frame-like body 84 or carriage within which it is confined. The fixed centerpost 80 constitutes, in effect, a guide member which allows for both vertical up and down motion, as well as lateral side (right and left) motion of the carriage 84 and the cam piece 90. The carriage 84 is capable of vertical up and down motions relatively to the block-like centerpost 80 which it surrounds, and is also being capable of limited lateral right and left sliding movement with respect to the fixed centerpost 80.

As will become more readily apparent presently, the aforementioned jaws J which perform the actual transfer operation are rotatably mounted on the outer, closed, loop-like or cage-like body 84 and, therefore, this body may be regarded as a jaw-supporting carriage inasmuch as it is this carriage and its associated jaws which actually engage and receive the blank B at one forming station and transfer it to the other forming station. Because the jaws J which are rotatably mounted on this carriage 84 turn throughout an angle of 180° during the transfer operation grasp the leading edge portion of the blank B which issues from the web W, and swing the blank around so that its leading edge becomes, in effect, its trailing edge when delivery of the blank is made to the second forming station of the punch press, this rotation of the blank through an angle of 180° accounts for a major portion of the linear transfer of the blank and, therefore, the actual linear shifting motion of the carriage 84 need only be a comparatively small distance.

For purposes of discussion herein the directional movements of which the two relatively movable components 84 and 90 are capable will be referred to as vertical or up and down movements and as lateral or right and left movements, the latter being in the general web line direction of the feeding motion of the web W.

The composite L-shaped cam piece 90 fits snugly within the confines of the frame-like body or carriage 84 and, therefore, insofar as lateral or right and left movements of these two members are concerned, the fixed centerpost 80 which, as mentioned before, is secured to the disc shoe 32 constitutes a guide for such members and the latter may be said to slide vertically on the centerpost 80, albeit, relatively to each other. Relative vertical motion between the two members 84 and 90 takes place under the influence of certain contoured cam slots or tracks which are provided in the vertically disposed rectangular cam plate 92 which is associated with the cam piece 90, and the nature of which will be described in detail presently.

Figure 3:
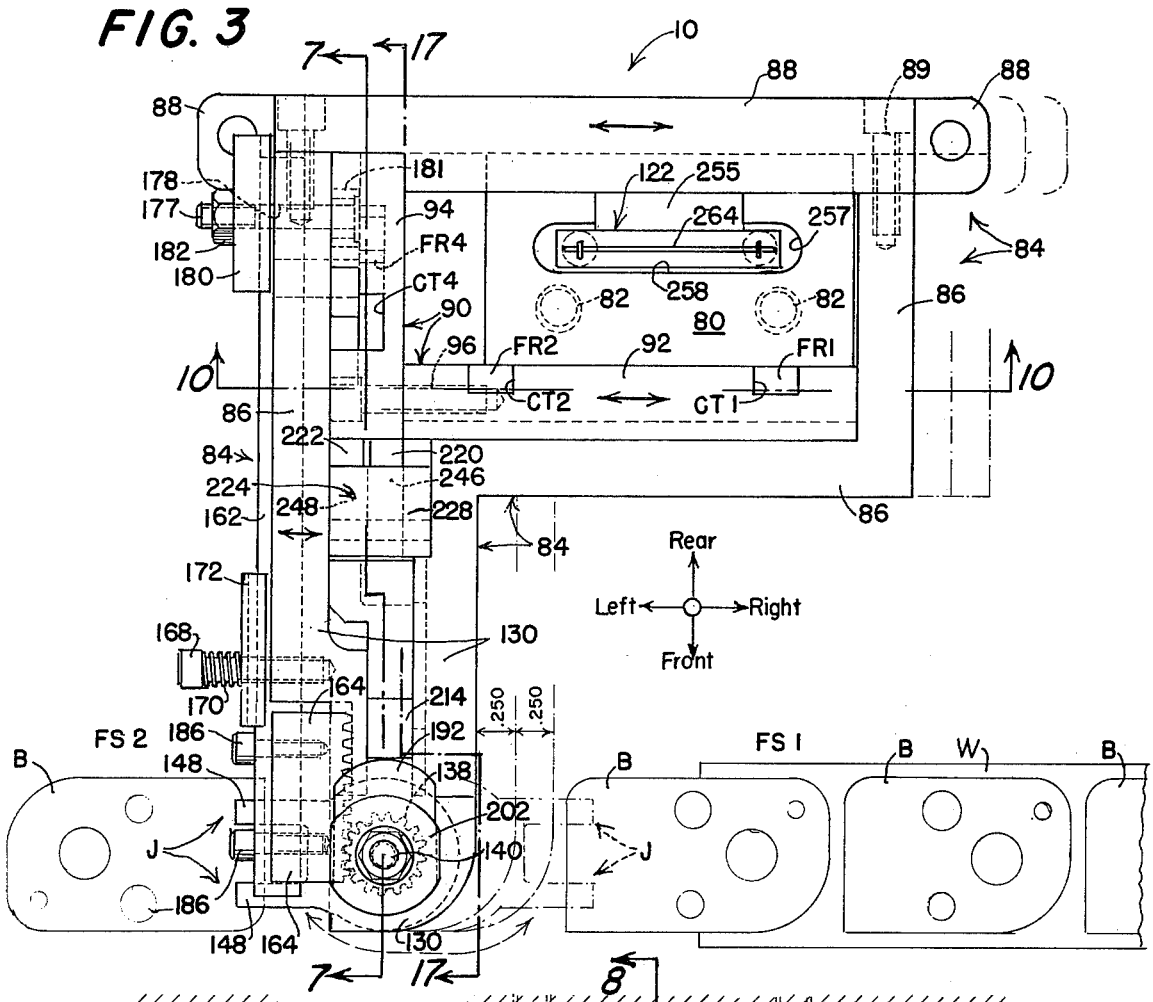
FIG. 3 is an enlarged top plan view of the transfer mechanism of the present invention, the view being taken on the line 3—3 of FIG. 1 and in the direction of the arrows.

Bearing in mind the fact that the frame-like body 84 is capable of both vertical and lateral motion in the area between the punch holder 36 and the die shoe 32, the lateral motion of said body is made possible by reason of the fact that both it and the cam piece 90 which it encompasses are slidable laterally on the centerpost 80 as indicated by the several double-ended arrows in FIG. 3. Each increment of such lateral motion of the frame-like body 84 is, of course, accompanied by a corresponding and equal lateral motion of the cam piece 90 inasmuch as the latter is closely confined within the former.

Figure 4:
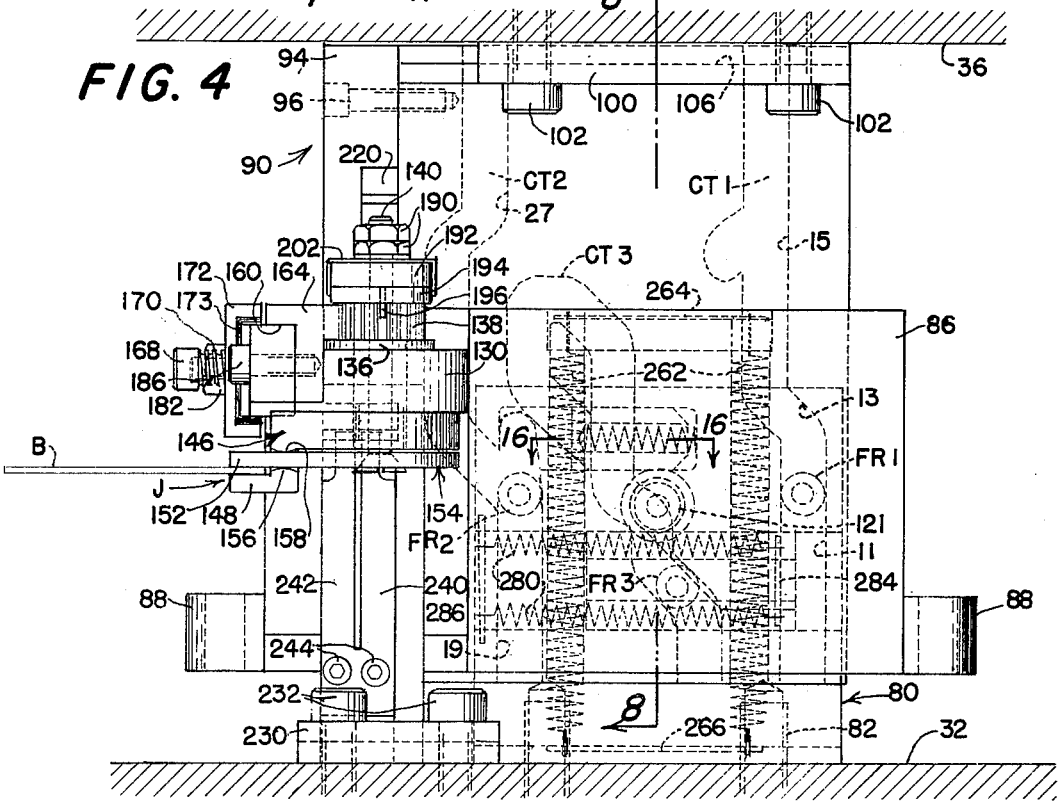
FIG. 4 is a front elevational view of the transfer mechanism of FIG. 3.
Figure 5:
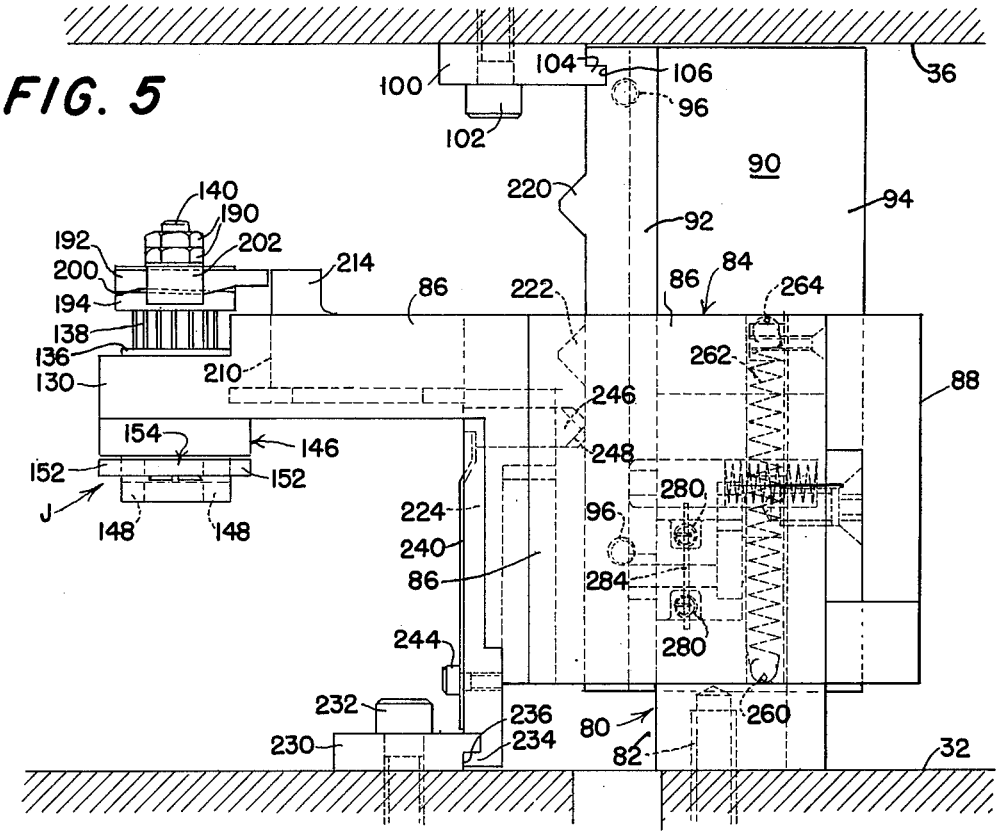
FIG. 5 is a right side elevational view of the transfer mechanism as shown in FIG. 4.

As clearly shown in FIG. 4 of the drawings, the composite cam piece 90 follows the up and down vertical movements of the punch holder 36 although it is slidable laterally relatively to such punch holder. Toward this end and with reference to FIGS. 4, 5, 6, 8, 17, 18, and 19, a guide piece 100 is secured by means of a pair of screws 102 to the underneath side of the punch holder 36 and embodies thereon a laterally projecting, horizontally extending rib 104 which projects into and is slidable in a horizontal groove 106 in the upper edge portion of the vertically extending rectangular cam plate 92. Since the centerpost 80 prevents any fore and aft movement of the body 84 and the cam piece 90, the rib 104 serves as a guide rail along which the upper end of the cam piece 90 is slidable and, during the upward and downward stroke of the punch holder 36, the rib 104 follows the vertical motions of the former.

Generally speaking, the three-component transfer mechanism 10 has a power input which derives its motion from the vertical reciprocation of the punch holder 36 of the punch press 12, such power input consisting of the vertically movable cam piece 90. The power output of the transfer mechanism 10 consists of the aforementioned blank-engaging jaws J which bodily follow the up and down and the right and left lateral movements of the frame-like body 84 on which they are carried and which also are independently rotatable throughout an angle of 180° in a manner that will be set forth in detail presently. Since the centerpost component 80 is fixed to the stationary die shoe 32, it constitutes a reaction member which assimilates the thrust of the power input member, i.e., the vertically movable cam piece 90. The frame-like body 84 thus is a floating member in the sense that its movements are a function of the relative movements that take place between the fixed centerpost 80 and the powered vertically movable cam piece 90. Stated otherwise, the vertical up and down movements of the frame-like body or carriage 84 and also the right and left lateral movements thereof are derived solely from the vertical movements of the cam piece 90.

It will be recalled that movement of the body 84 to the right is effected in order to enable the jaws J to straddle the leading edge of a blank at the first forming station FS1 and that upward movement of the body 84 is effected to raise the blank B clear of the web W at said first forming station so that it may be rotated throughout an angle of 180°. Movement of the body or carriage 84 to the left is effected in order to draw the jaw-supported blank B clear of the forming station FS1 and, after a full 180° rotation of the jaws and the blank, also to deposit the blank at the second forming station FS2 where further work may be performed thereon. It will also be recalled that during the leftward movement of the body or carriage 84, the desired 180° rotation of the jaws J and the blank B takes place.

As will be described in greater detail presently, rightward movement of the frame-like body of carriage 84 is effected under the control of a pair of irregular but generally vertical cam tracks CT1 and CT2 (see FIGS. 3, 10, and 11 to 15) in the vertically disposed cam plate 92 of the cam piece 90, while the leftward movement of said body 84 is effected under the control of the cam track CT2 alone. The cam tracks CT1 and CT2 have associated therewith respective cam follower rollers FR1 and FR2 which are mounted on the centerpost 80 and, therefore, are directionally fixed so that as such rollers are traversed by the cam tracks, leftward or rightward movement, as the case may be, is applied to the entire L-shaped cam piece 90 and, consequently, to the entire frame-like body 84. Rightward movement is applied to the cam piece 90 and the body 84 when the follower roller FR1 encounters an offset 13 (see FIGS. 10 and 20) in the cam track CT1 during downward motion of the cam piece 90, and also when the follower roller FR2 encounters an offset 25 in the cam track CT2 during upward motion of the cam piece 90. Leftward motion of the frame-like body 84 occurs when the follower roller FR2 encounters an offset 21 in the cam track CT2 during upward movement of the cam plate 92.

The cam plate 92 is provided with a third generally vertical cam track CT3 and this has associated with it a follower roller FR3 (see FIGS. 9 and 10) which is carried on a spring-biased, horizontally extending slide member 116. The latter rides in a horizontally extending groove 118 in the centerpost 80, the slide embodying on its rear face an inclined cam surface 120 which cooperates with a follower roller 121 on a second slide member 122. The latter has, as described hereafter, a front part which slides up and down in a vertical groove 124 in the rear face of the centerpost 80, and, in addition, a rear part which slides horizontally in a horizontal groove 126 in the back plate 88 of the frame-like body 84. The relationship of the centerpost 80, the two slide members 116 and 122, and the back plate 88 will be set forth in detail subsequently but, for the present, it is deemed sufficient to state that, by such relationship, traversing of the follower roller FR3 by the cam track CT3 serves to effect vertical up and down floating but controlled movements of said frame-like body 84.

Considering now the blank-engaging jaws J with specific reference to FIGS. 3, 4, 7 and 8 of the drawings, these jaws are carried at the outer end of a comparatively narrow, forwardly and horizontally extending, loop-like extension 130 which constitutes an integral portion of the frame-like body 84. A vertical bore 134 (see FIG. 7) near the outer end of the extension receives therein a cylindrical liner or bushing 136. Disposed within this bushing 136 is a pinion 138 through which there extends centrally a vertical bolt 140 (see FIGS. 5 and 6). The pinion 138 is provided with a depending cylindrical hub portion 142 which is rotatable within the bushing 136. The lower end region of the hub portion 142 is provided with an integral reduced, externally threaded section 144 which threadedly receives thereon a generally Z-shaped jaw member 146 (see particularlyFIGS. 3 and 4). Said jaw member has a bifurcated, horizontally extending lower leg which establishes a pair of lower jaw fingers 148 (see also FIGS. 7 and 8).

Figure 7:
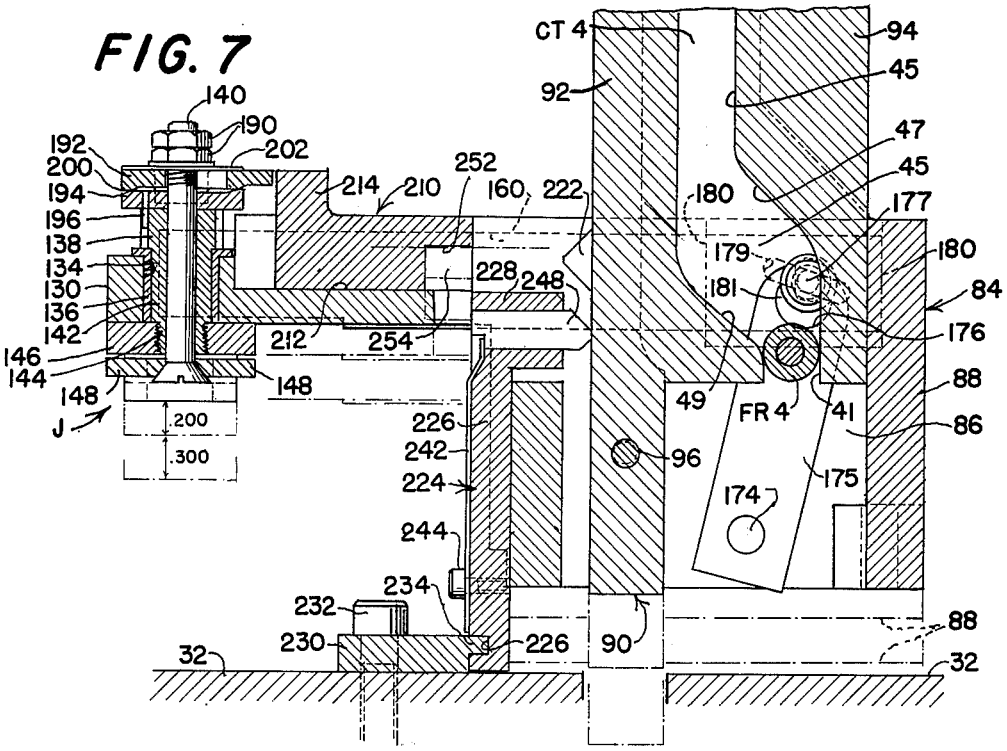
FIG. 7 is a vertical sectional view taken on the line 7—7 of FIG. 3.

As best shown in FIG. 4 of the drawings, the Z-shaped jaw member 146 is provided with a reduced width, vertically extending intermediate web portion 150 (see FIG. 18) which is straddled by a pair of horizontally extending upper jaw fingers 152. The latter are provided or formed on a floating upper jaw member 154 and of flat plate-like construction. The jaw member 154 has a hole through which the lower region of the bolt 140 extends and is supported on the bolt head at the lower end of the bolt as best shown in FIG. 7. The inner or proximate ends of the lower jaw fingers 148 are formed with upstanding lugs 156 and these have curved upper surfaces which constitute fulcrum areas for permitting rocking motion of the floating upper jaw member 154. The inner portion of the upper leg of the Z-shaped jaw member 146 is formed with a pair of depending lugs 158 which have curved lower surfaces and oppose the lugs 156 (see FIG. 4) and bear against the upper surface of the floating upper jaw member 154 with a fulcrum action. Thus, and as will be set forth in greater detail presently, when the bolt 140 is placed under the tension in such a manner as to draw the head thereof upwardly, the upper floating jaw member 154 will rock upon the curved fulcrum surfaces or areas of the lugs 156 and 158 and thereby close the pairs of jaw fingers 148, 152 upon each other so as firmly to grip a blank B therebetween. When the tension in the bolt 140 is relieved, the blank will be released. The manner in which the bolt is placed under tension for jaw-gripping purposes will be described hereafter.

Figure 6:
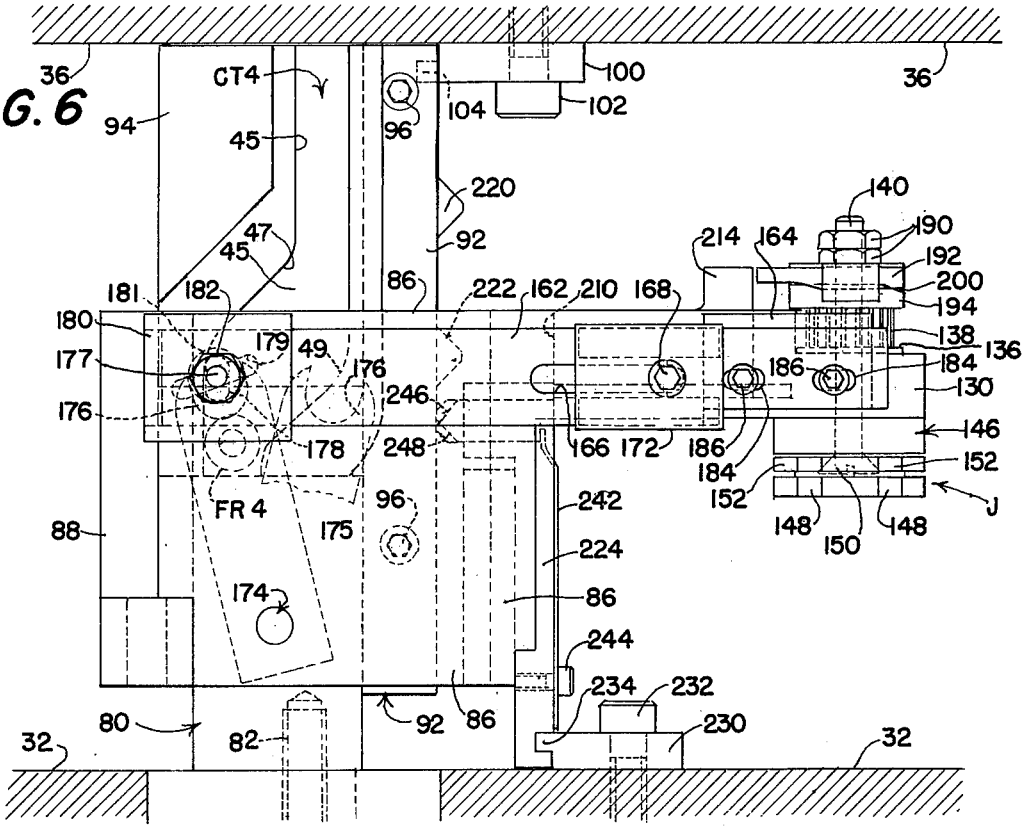
FIG. 6 is a left side elevational view of said transfer mechanism as shown in FIG. 4.
Figure 17:
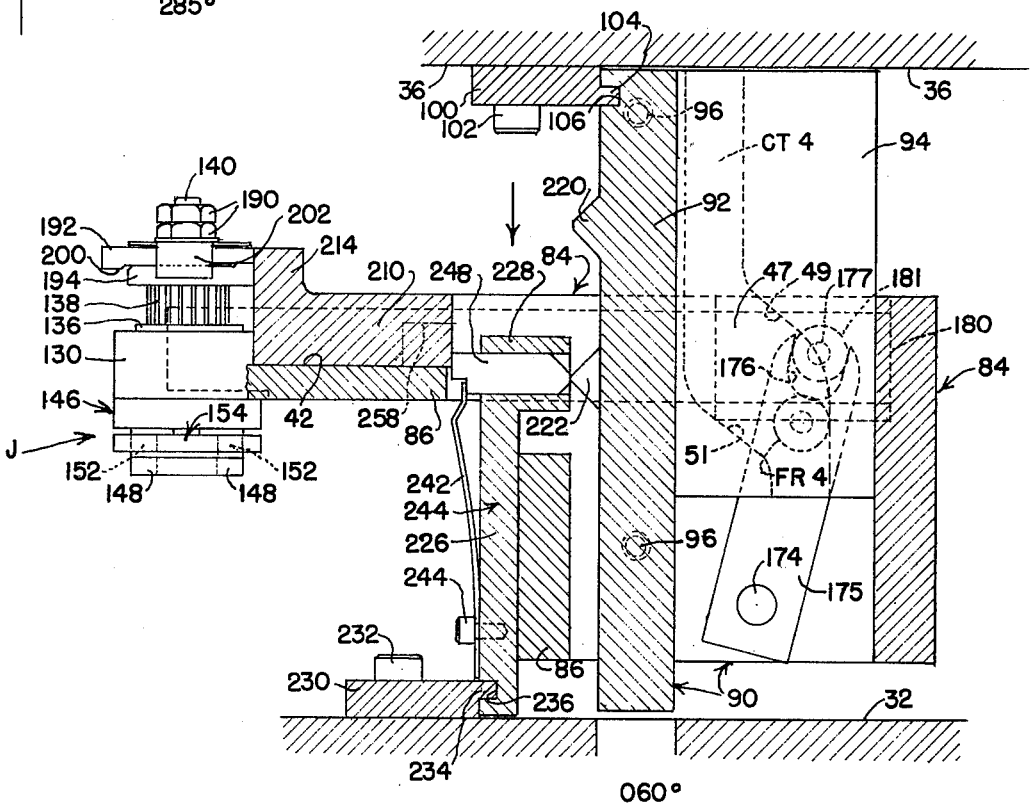
FIG. 17 is a vertical sectional view taken on the line 17—17 of FIG. 3, parts of the transfer mechanism being shown in the positions which they assume at 60° in the machine cycle.
Figure 18:
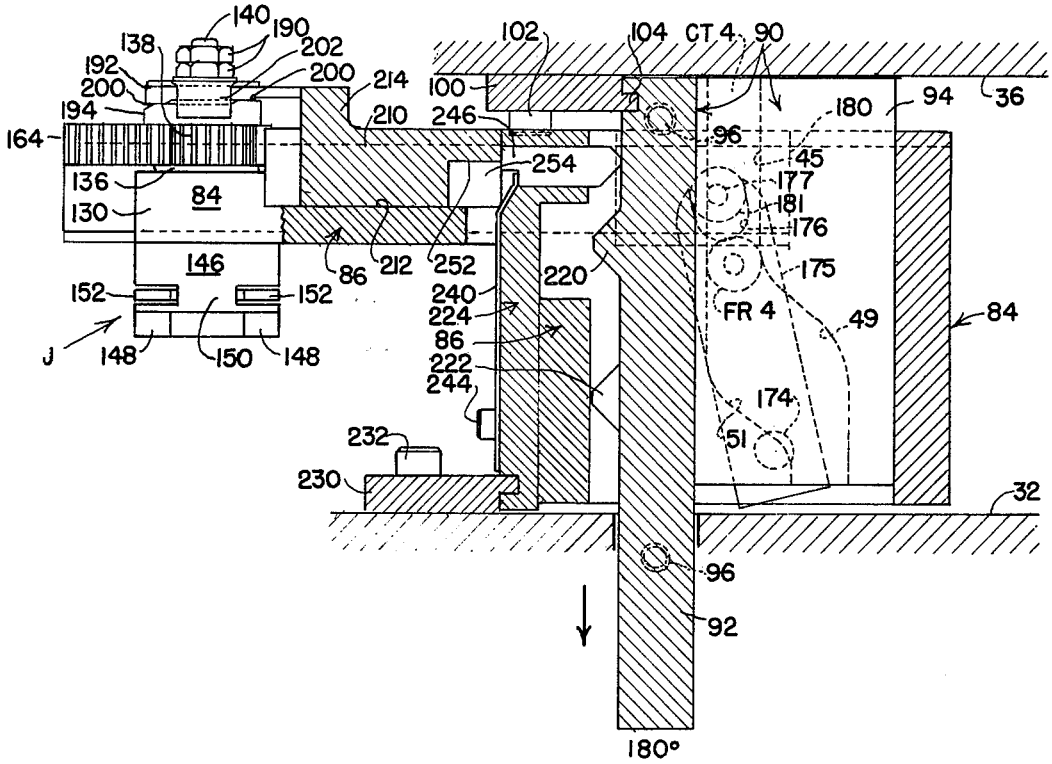
FIG. 18 is a vertical view similar to FIG. 17 but showing the transfer mechanism parts in the positions
Figure 19:
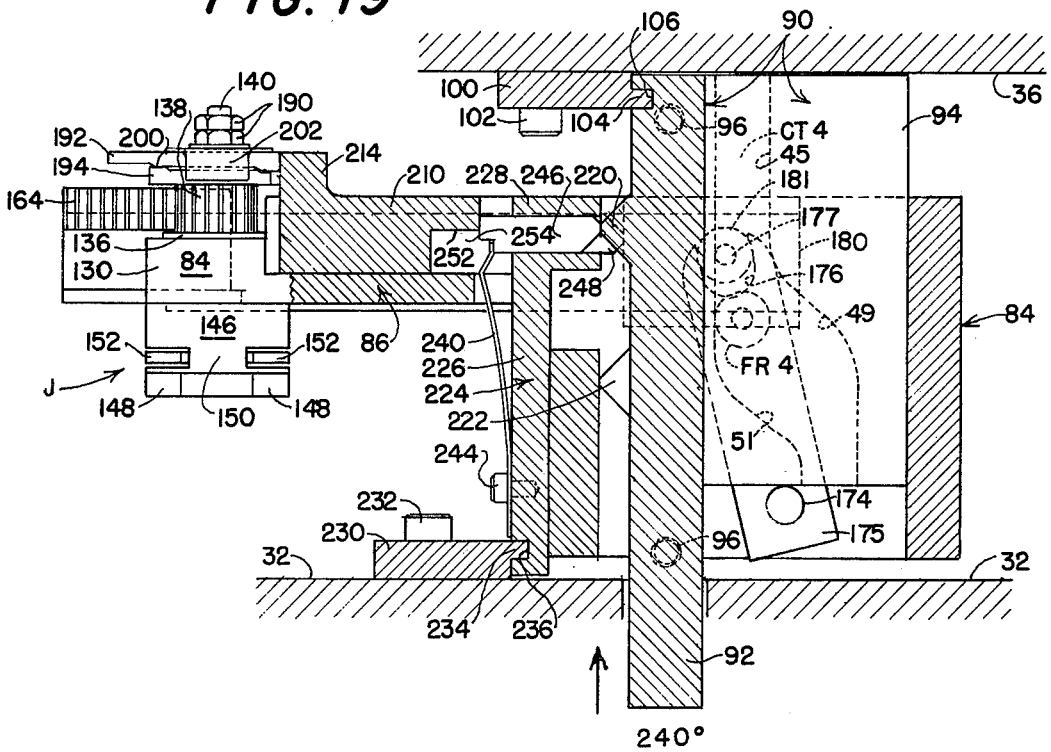
FIG. 19 is a vertical sectional view similar to FIG. 17 but showing the transfer mechanism parts in the positions which they assume at 240° in the machine cycle.

Referring now to FIGS. 4 to 8 and also FIGS. 17, 18, and 19, the left side wall of the U-shaped frame member 86 of the frame-like body 84 is provided in its outer side face with an elongated horizontally extending groove 160 in which there is slidable in a fore and aft direction a horizontally extending rack bar 162, the latter having a rack 164 adjustably mounted on the forward end thereof. As best shown in FIG. 6 of the drawings, the rack bar 162 is provided with an elongated horizontal slot 166 in the front central region thereof and a horizontal bolt 168 (see FIG. 4) projects loosely through the slot and is threadedly received in the left side wall of the frame member 86 of the body 84. A spiral compression spring 170 is interposed between the head of the bolt 168 and a saddle-like friction or drag shoe 172. The latter has a leather liner 173 therein, and thus straddles the rack bar 162 and serves yieldingly to force the rack bar 162 against the bottom of the groove 160 and, thus, retain the rack bar 162 within such groove against dislodgment. The liner 173 also serves to prevent overrunning of the rack bar in a longitudinal direction during operation of the rack bar as will become clear presently.

The rack 164 at the forward end of the rack bar 162 is T-shape in cross section as best seen in FIG. 4 and one side portion of the horizontal top leg of the rack is provided with a longitudinal series of teeth which mesh with the pinion 138. Longitudinal reciprocation of the rack 164 for pinion-rotating purposes is effected under the control of the vertical movements of the cam piece 90 and, specifically, under the control of a cam track CT4 (see FIGS. 7, 8. 17, 18 and 19) which is formed in the left side of the cam plate 94 of the two-part cam piece 90. The terms "right" and "left," "forward" and "rearward" and certain other directional references which are made herein are related to the entire assembled transfer mechanism 10 as a whole and as viewed in FIG. 1, and are not necessarily related to any given view of the drawings unless otherwise specifically stated.

The left wall of the U-shaped frame member 86 carries a horizontal stud 174 (see FIGS. 6, 7 and 17) near the lower portion thereof and an upstanding rocker arm 175 has its lower end pivoted on such stud. The upper end of the rocker arm 175 is bifurcated as indicated at 176 and receives therein the cylindrical head of a horizontally extending shouldered bolt 177 (see FIG. 6) which passes through the left side wall of the U-shaped frame member 86, as well as through a slot 178 (see FIGS. 3 and 6) in the rear end region of the rack bar 162, and also through an inclined slot 179 (see FIGS. 6 and 7) in a saddle-like member 180. A roller 181 on the bolt 177 is received in the bifurcation 176 and is held in place by means of the head of bolt 177. A nut 182 is threadedly received on the bolt 177 and, when tightened, serves to clamp the saddle-like member 180 against the rack bar 162. The upper region of the rocket arm carries a follower roller FR4 which travels in the aforementioned cam track CT4 in the left face of the cam plate 94 of the L-shaped cam piece 90.

From the above description, it will be observed that as the follower roller FR4 is traversed by the cam track CT4 during the up and down movements of the two-part, L-shaped cam piece 90, the rocker arm 175 will be swung in opposite directions, thus effecting reciprocation of the rack bar 162 and, consequently, the rack 164, thereby causing the pinion 138 to rotate in opposite directions throughout an angle of 180°, one complete cycle of rotation taking place during each punch press cycle, as will be made clear subsequently when the operation of the transfer apparatus 10 is set forth more in detail hereafter. Rotation of the pinion 138 back and forth will, of course, cause the blank-clamping jaws J to reverse their direction during each machine cycle.

The throw or stroke of the rack bar 162 and its associated rack 164 may be regulated to a minor degree by means of lateral adjustment of the bolt 177 with respect to the inclined slot 179. By loosening the nut 182 and sliding the saddle-like member 180 in one direction or the other longitudinally of the rack bar 162, the elevation of the bolt 177 may be varied so that its head and the roller 181 assume different positions within the bifurcated upper end 176 of the rocker arm 175. Upward adjustment of the bolt and rollers serves to increase the effective length of the crank arm, thereby increasing the throw or stroke of the rack bar 162. Conversely, lowering of the bolt 177 serves to decrease such throw or stroke.

The fore and aft positions of the rack 164 on the rack bar 162, i.e., the advanced and retracted positions thereof, may be adjusted by means of a pair of horizontal slots 184 (see FIG. 6) which are provided in the front end region of the rack bar 162 and receive therethrough respective bolts 186. The latter have the free ends of their shanks threadedly received in internally threaded sockets in the vertical leg of the T-shaped rack 162. Upon loosening of the bolts 186, the rack 164 may be slid in either direction with respect to the rack bar 162 and the bolts again tightened in order to lock the rack in its adjusted position.

Figure 8:
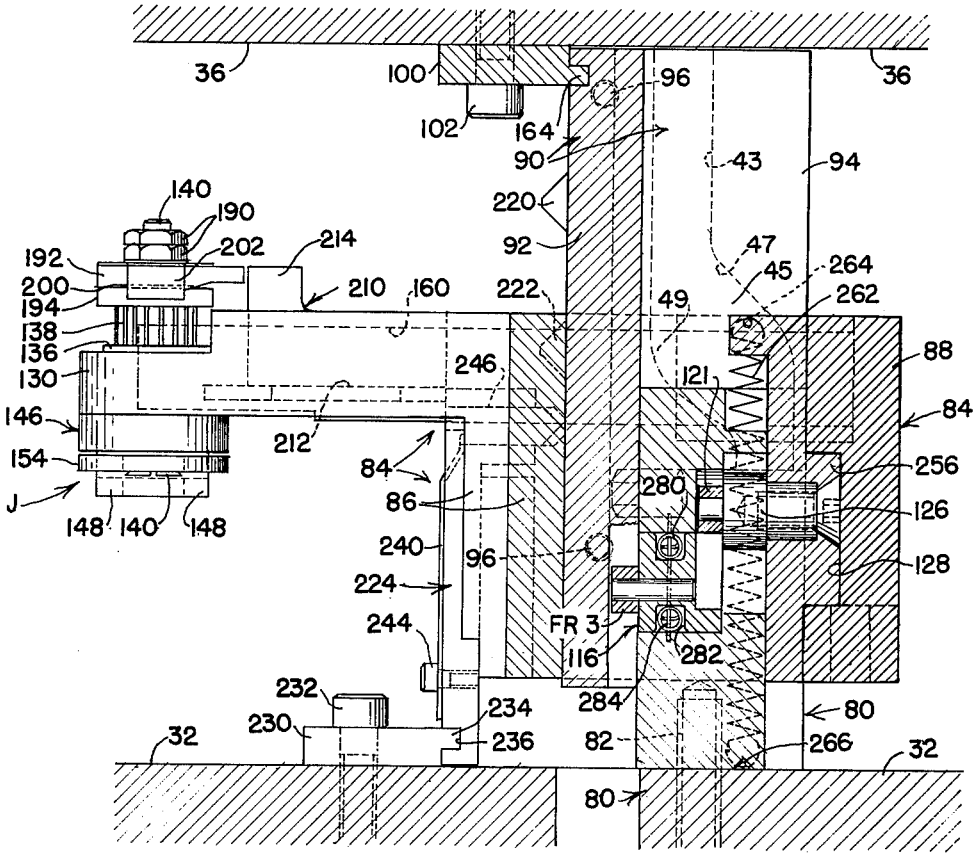
FIG. 8 is a vertical sectional view taken on the line 8—8 of FIG. 4.

Referring now to FIGS. 3 to 8, and FIG. 17 of the drawings, means are provided for automatically locking the jaws J in their closed positions in order to grip a blank B securely therebetween when the frame-like body 84 is moved to its extreme right position and when the jaws face toward the right so that the jaw fingers 148 and 152 straddle the blank, and also for automatically unlocking the jaws J in order to release the blank therefrom when the body 84 is moved to its extreme left position and when the jaws face to the left. Toward this end, a pair of lock nuts 190 is threadedly received on the upper end of the bolt 140. Immediately beneath such lock nuts is a pair of wedge members including an upper member 192 and a lower member 194. As best shown in FIG. 7, the lower wedge member 194 is rotatably mounted on the bolt 140, seats upon the pinion 138, and follows the 180° motion of the latter by reason of a vertically extending key-type pin 196 (see FIGS. 4 and 7) which extends through the member 194 and between a pair of adjacent teeth on the pinion 138. The upper wedge member 192 has formed therein a slot 198 through which the bolt 140 projects. The upper wedge member 192 is thus slidable on the lower wedge member 194 within the limits afforded by the slot 198. The two wedge members are provided with cooperating marginal wedge lobes 200 which, when the lobes are in contact with each other as shown in FIGS. 7, 8, and 18, serve to place the bolt 140 under tension, thus drawing the right-hand portion of the floating jaw member upwardly as viewed in FIG. 4 and resultantly causing such jaw member to rock upon the coacting fulcrum lugs 156, 158 and thus cause the jaw fingers 148, 152 to close upon each other in blank-engaging relationship. When the wedge lobes 200 are out of contact with one another the upper wedge member 192 will move downwardly a slight distance as shown in FIG. 17, thus relieving the tension in the bolt 146 and allowing the jaw fingers 148, 152 to open and release the blank B. It will be understood that the lock nuts 190 will be initially adjusted according to the thickness of the particular blank B undergoing transfer.

As best shown in FIGS. 3 and 4 of the drawings, the upper wedge member 192 is formed with arcuate ends and is appreciably longer than the lower wedge member 194 which is disposed immediately therebeneath. The two members 192 and 194 are constrained to rotate in unison with the pinion 138 by means of the aforementioned keying pin and also by means of a saddle-like member 202 (see FIG. 8), the side flanges of which embrace both wedge members.

The upper wedge member 192 is slidable on the lower wedge member 192 as previously mentioned, sliding motion taking place only when the jaws J face either to the right or to the left. At such time, the longitudinal axes of the wedge members extend in a fore and aft direction and are coincident with the longitudinal axis of the loop-like extension 130 of the frame-like body 84. Such is the case because the axes of the jaw members 192 and 194 extend at a right angle to the axes of the jaws and because said members rotate in unison with the jaws so that the right angular relationship remains unchanged at all times.

When the upper wedge member 192 is in either of the extreme rotational positions of which it is capable of assuming, it is capable of fore and aft sliding movement on the lower jaw member 194 between a retracted rear position and an advanced or projected forward position. If the wedge member 192 is in its projected forward position at such time as the rack 164 is advanced so that the jaws J face toward the left as shown in FIGS. 3 and 4, then it is so mismated with the lower wedge member 194 that the wedge lobes 200 are out of register with one another, and the bolt 146 is not under tension. The jaws J are, therefore, released or are in their open condition. If the upper wedge member 192 is in its retracted position while the jaws face to the left, then the two wedge members 192 and 194 are mated so that the lobes 200 are in direct contact or register with one another and the jaws J are, therefore, in clamping engagement with the blank undergoing transfer. If the upper wedge member 192 is in its retracted rear position at such time as the rack 164 is retracted so that the jaws J face to the right, then it is completely mated with the lower wedge member 194 so that the wedge lobes 200 are in contact with one another and the bolt is under tension. Under these circumstances, the jaws J are in their closed or blank-gripping relationship. If the upper wedge member 192 is in its projected forward position while the jaws J face to the right, then the two wedge members 192 and 194 are mismated and the wedge lobes 200 are out of contact with one another so that the jaws J become open and thne release the blank B.

Means are provided for automatically and positively shifting the upper wedge member 192 from its retracted position to its projected position both when the jaws J face to the left and also when they face to the right. Accordingly, and with particular reference to FIGS. 7, 8, 17, 18, and 19 of the drawings, a pusher block 210 is slidable on a horizontal integral ledge or shelf 212 which extends between the right and left sides of the forwardly and horizontally extending loop-like frame extension 130 of the frame-like body 84 and has formed on its front end portion an integral upwardly extending lug 214, the latter being designed for engagement with the rear arcuate edge of the upper wedge member 192. The pusher block 210 is movable between the rearward position in which it is shown in FIGS. 3, 5, 7, 8, and 18, and the forward position in which it is shown in FIGS. 17 and 19. The pusher block 210 moves from its retracted position to its projected position twice during each punch press cycle, the first of these movements serving to shift the upper wedge member 192 forwardly so as to disengage the wedge lobes 200 as shown in FIG. 19, relieve tension in the bolt 140, and thus cause the jaws J (which at that time face to the left) to open and release the blank B. The second such forward movement of the pusher block 210 serves to shift the upper wedge member 192 (which now has been reversed through an angle of 180°) forwardly so as to engage the wedge lobes 200 as shown in FIG. 7, create tension in the bolt 140, and thus lock the jaws J in their closed blank-gripping position.

The forward motion of the pusher block 210 is effected under the control of a pair of V-shaped cam protuberances consisting of an upper protuberance 220 and a lower protuberance 222 (see FIGS. 5, 6, 7, 8, 17, 18, and 19) which are formed on the forward vertical surface of the cam plate 94 but are laterally offset. As best seen in FIGS. 17, 18, and 19 of the drawings, an upstanding, inverted, L-shaped guide member 224 comprising a vertical leg 226 and a short horizontal rearwardly exending leg 228 at the upper end of the vertical leg fits against the outer side of the front wall of the U-shaped frame member 86 of the body 84 so that it is slidable horizontally. Such guide member 224 is slidably connected to the die shoe 32 by means of a hold-down block 230 which overlies directly the upper surface of said die shoe and is secured thereto by a vertical clamping bolt 232. A horizontal tongue or rib 234 on the upper rear corner of the block 230 projects into a horizontal groove 236 in the lower end region of the vertical leg 226 of the L-shaped guide member 224 and thus allows for lateral shifting movement of the guide member 224. Said guide member is constrained to follow the lateral motion of the frame-like body 84 by reason of the fact that it is confined between the opposite walls or sides of the extension 130 as shown in FIG. 3, but it is incapable of vertical movement due to its sliding connection (rib 234 and groove 236) with the hold-down block 230.

Figure 20:
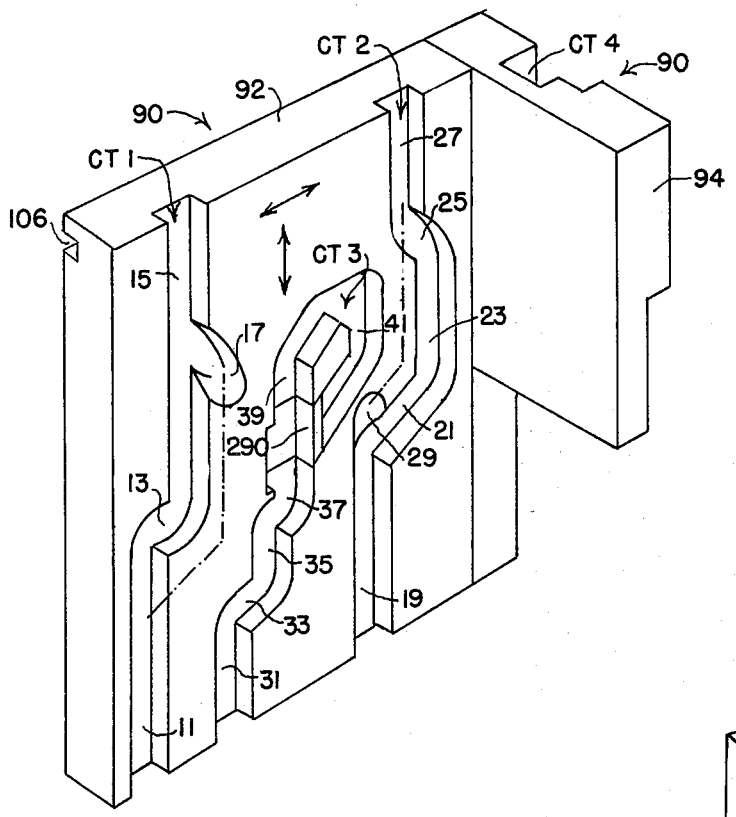
FIG. 20 is a rear right perspective view of a cam plate which is employed in connection with the present invention, such view illustrating schematically the relative movements between certain cam tracks which are associated therewith and their respective cam followers.

As shown in FIGS. 4, 7, 8, 17, 18, and 19 of the drawings, two vertically extending, side-by-side leaf springs 240 and 242 have their lower ends secured by bolts 244 to the lower portion of the front wall of the U-shaped frame member 86, and the upper ends of the leaf springs bear respectively against the forward end portions of a pair of horizontally extending, side-by-side, thrust links 246 and 248. Such links extend lengthwise of the loop-like extension 130 of the U-shaped frame-like body 184 and are mounted for fore and aft sliding movement within a channel 250 which is formed in the horizontal leg 228 of the guide member 224. The upper end of the leaf spring 240 is disposed in an undercut notch in the front lower corner portion of the thrust link 246, and the upper end of the leaf spring 242 is disposed in an undercut notch in the front lower corner portion of the thrust link 248. The function of the two leaf springs is to urge rearwards their respective thrust links 246 and 248 to the end that the rearward ends of such links bear normally against the forward vertical surface of the cam plate 94 and are subject to the action of the cam protuberances 220 and 222. The function of said two thrust links is to transmit motion of the V-shaped cam protuberances 220 and 222 to the pusher block 210 either to lock the jaws J in their closed blank-engaging position when the upper wedge member 192 is in its retracted position and the jaws J face to the right or to unlock the jaws and allow them to become open and thus release the blank B when the jaws face to the left. As will be described in greater detail subsequently, when the operation of the present transfer mechanism 10 in connection with the timing chart of FIG. 20 is set forth, unlocking of the jaws J is initiated during downward sliding movement of the L-shaped cam piece 90 as shown in FIG. 17, while the lower cam protuberance 222 engages the rear end of the thrust link 248 and while the forward end of the thrust link 248 engages the lower edge region of the pusher block 210. Locking of the jaws J is initiated during upward sliding movement of the cam piece 90 as shown in FIG. 19 while the cam proturberance 220 engages the rear end of the thrust link 246 and while the forward end of the thrust link 248 engages the rear end of the pusher block 210 in the vicinity of the roof portion 252 of a rectangular recess 254 which is formed in the rear end region of said pusher block.

Figure 9:
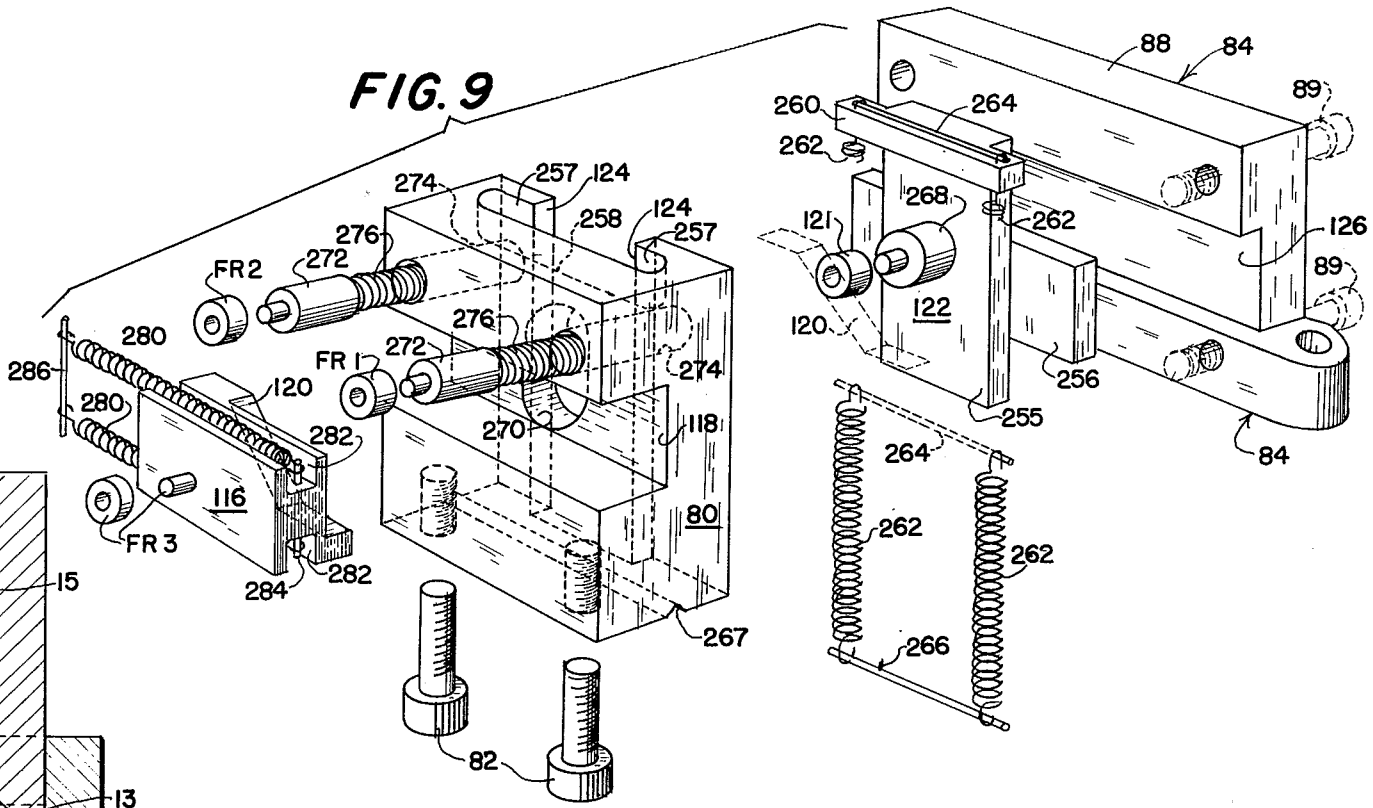
FIG. 9 is an enlarged, fragmentary, exploded, perspective view of certain portions of the present transfer mechanism.

Referring now to FIGS. 4, 8, 9, and 10 of the drawings, and particularly to FIG. 9, the aforementioned centerpost 80, the slide member 116, and the slide member 122 may be regarded as a composite centerpost assembly and, as such, it is shown as being bracketed in FIG. 9. It will be recalled that the centerpost 80 is fixedly secured by the screws 82 to the die shoe 32 of the punch press 12 and is, therefore, immobile or fixed.

The slide member 122 is generally in the form of a cross and it embodies a vertical rectangular part 255 and a horizontal rectangular part 256, the two parts being fixedly secured together in right angular relation in any suitable manner. The horizontal part 256 is slidably received within the aforementioned horizontal groove 126 which is formed in the back plate 88 of the frame-like body 84 while the vertical part 255 is slidably received in the aforementioned vertical groove 124 in the centerpost 80.

The upper portion of the vertical groove 124 in the centerpost 80 is intersected by a dovetail slot 257 which is of shallow depth and has a bottom wall 258 which is disposed a slight distance beneath the level of the top face of the centerpost. The upper end portion of the vertical part 255 of the slide member 122 is provided with a horizontally extending, forwardly offset anchor rib 260 which has its ends in overhanging relation with the side edges of said part 255, is normally disposed within the dovetail slot 257, and rests upon the bottom wall 258 of the latter. A pair of tension springs 262 serves to urge the slide member 122 downwards to the end that the anchor rib is firmly held in its sealed position on the bottom wall 258 of the dovetail slot 257. The upper ends of the springs 262 are hooked over a rod 264 which overlies and extends lengthwise of the rib 260, and the lower ends of said springs are hooked around a similar rod 266 which underlies the centerpost and seats within a transversely extending groove 267 in the bottom face of said centerpost. When the slide member 122 is in its normal position, the top and bottom edges thereof lie substantially flush with the top and bottom faces of the centerpost 80. However, as the cage-like body 84 is caused to shift vertically relatively to the centerpost 80, the consequent upward movement of the slide member 112 will raise the anchor rib 260 from the dovetail slot 256 and elevate the vertical part 252 against the action of the two tension springs 262. The lowermost position of the slide member 122 with respect to the centerpost is determined by a cylindrical boss 268 which is provided on the front face of the vertical part 252 of said slide member and travels in an elongated vertically extending slot 270 in that portion of the centerpost which defines the vertical wall of the guideway 124. When the slide member 122 is in its normal position, such boss engages the lower end of the slot 70. The follower roller 121 is rotatably mounted on a horizontal spindle which is attached to and extends forwards from the outer end of the boss 268.

Figure 10:
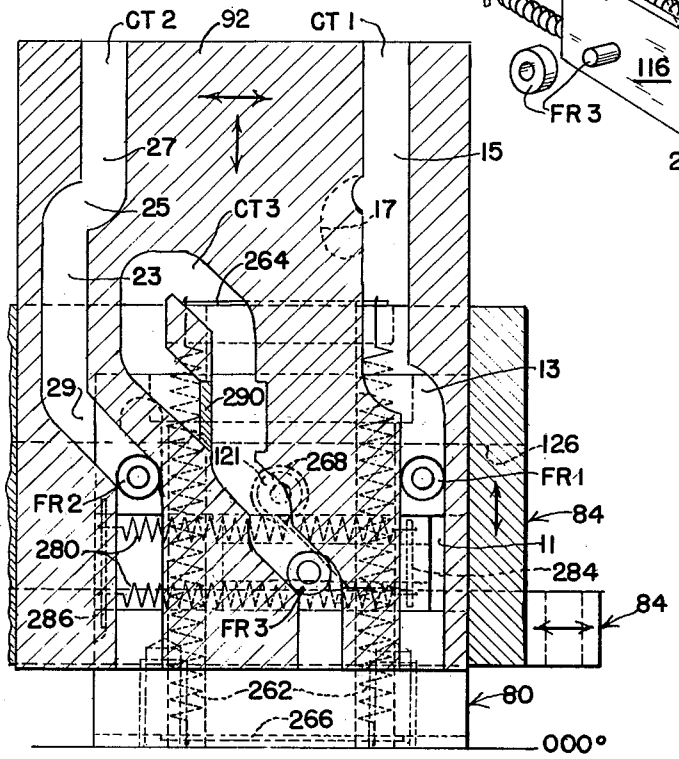
FIG. 10 is a vertical sectional view taken on the line 10—10 of FIG. 3, the transfer mechanism parts being shown in the positions which they assume at the commencement of each punch press or machine cycle, i.e., at the 0° position.
Figure 11:
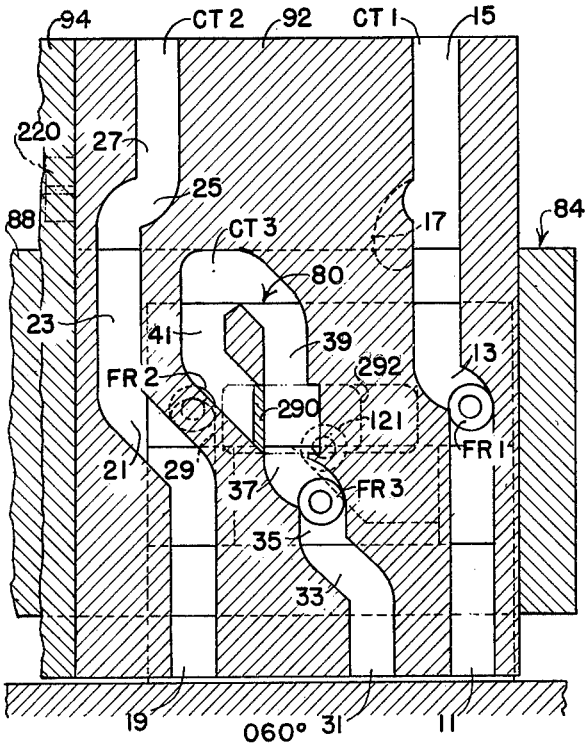
FIG. 11 is a vertical sectional view similar to FIG. 10 but showing the transfer mechanism parts in the positions which they assume at 60° in the machine cycle.
Figure 12:
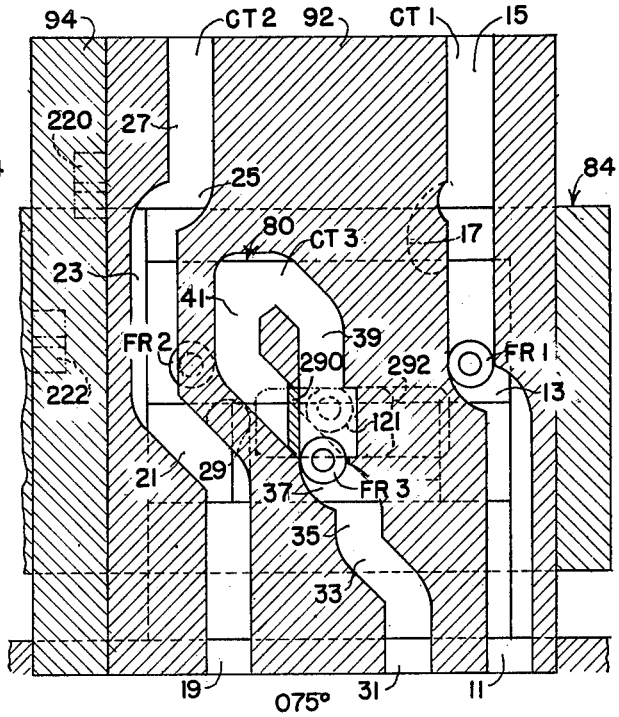
FIG. 12 is a vertical sectional view similar to FIG. 10 but showing the transfer mechanism parts in the positions which they assume at 75° in the machine cycle.
Figure 13:
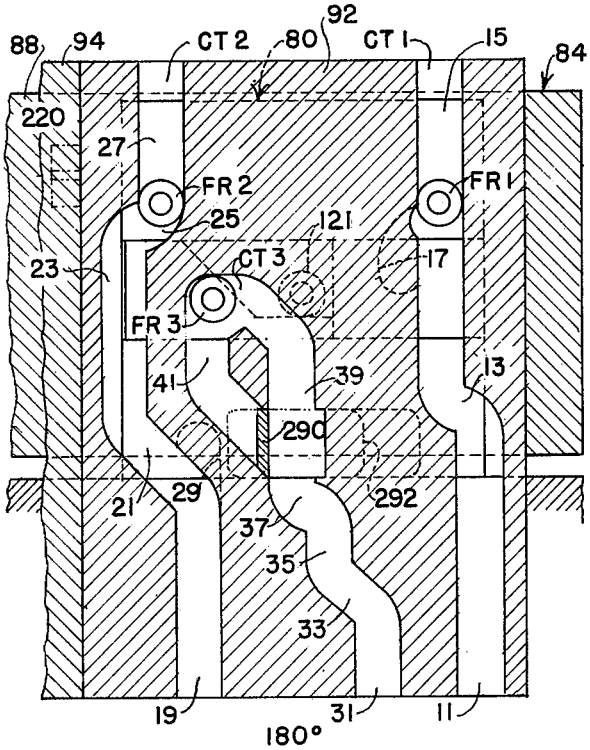
FIG. 13 is a vertical sectional view similar to FIG. 10 but showing the transfer mechanism parts in the positions which they assume at 180° in the machine cycle.
Figure 14:
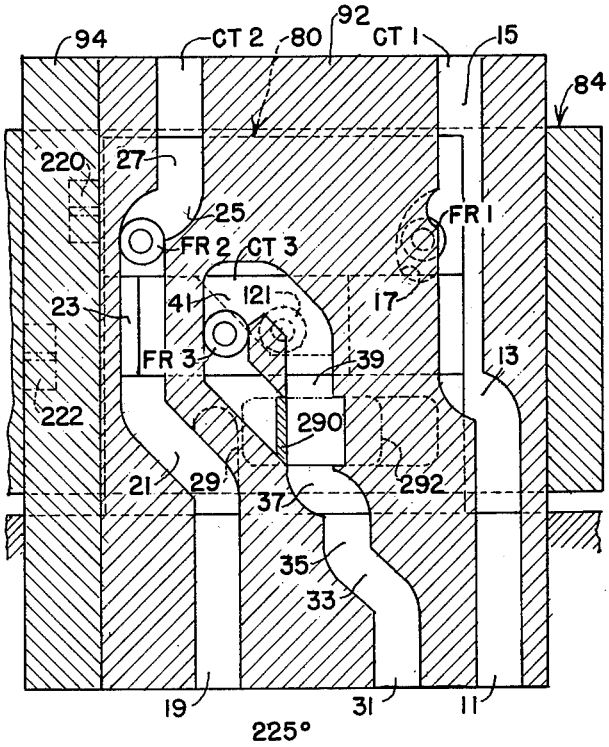
FIG. 14 is a vertical sectional view similar to FIG. 10 but showing the transfer mechanism parts in the positions which they assume at 225° in the machine cycle.
Figure 15:
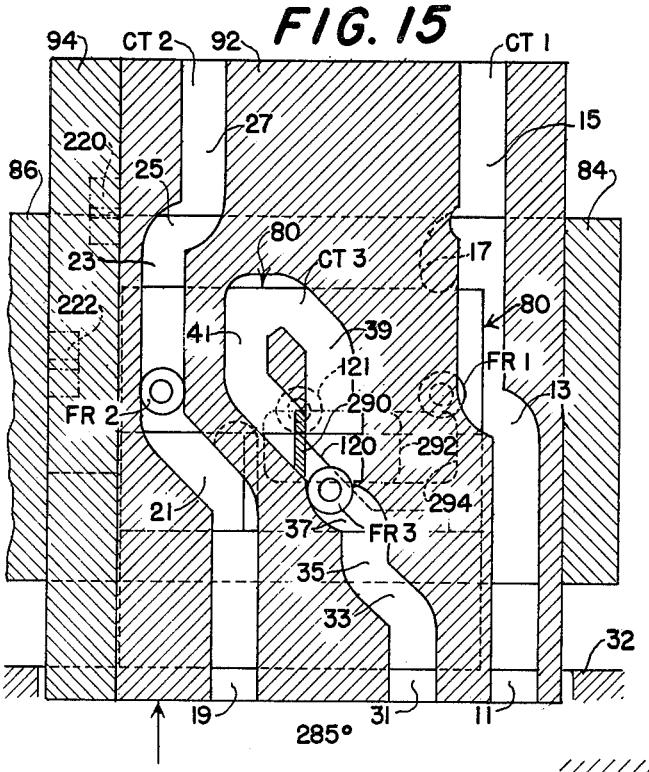
FIG. 15 is a vertical sectional view similar to FIG. 10 but showing the transfer mechanism parts in the positions which they assume at 285° in the machine cycle.
Figure 16:
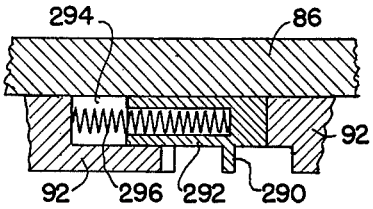
FIG. 16 is an enlarged horizontal sectional view taken on the line 16—16 of FIG. 4 and illustrating the nature of a cam gate which is employed in connection with the invention.

Still referring to FIG. 9 and additionally to FIG. 10, the aforementioned follower rollers FR1 and FR2 which cooperate with the cam tracks CT1 and CT2, respectively, are yieldingly mounted on the centerpost 80 for forward projection into their respective cam tracks by means of a pair of horizontally extending cylindrical plungers 272. The latter are slidably disposed in horizontal sockets 274 in the centerpost 81 and are yieldingly urged forwardly by a pair of helical compression springs 276. The follower rollers FR1 and FR2 are rotatably carried at the forward or outer ends of the plungers 272.

The slide member 116 is in the form of a generally rectangular body the rear side of which is suitably recessed or spaced in order to provide the aforementioned inclined cam surface 120. Such cam surface is so disposed and arranged that during movement of the slide member 116 along the horizontal groove 118 in the front face of that centerpost 80 it engages the follower roller 121 and effects a component of upward vertical movement to the slide member 122, and consequently, to the back plate 88 which constitutes a component of the frame-like body 84, thereby effecting vertical movement of such body.

A pair of horizontally extending tension springs 280 serve to bias or urge the slide member 116 to the left. These springs are disposed in upper and lower grooves 282 in the top and bottom faces of the slide member 116 and have their right-hand ends secured to fixed pins 284 at the right-hand ends of the grooves 282. The left-hand ends of the springs are secured to a vertically extending floating pin 286. The latter is of greater linear extent than the vertical width of the groove 118 so that in the normal position of the slide 116 the ends of the pin 286 engage those portions of the left side face of the centerpost which are above and below the left-hand end of the groove 118 while the springs 280 bias the slide to the left as heretofore mentioned.

Before entering into a description of the operation of the transfer mechanism 10, it is deemed pertinent to discuss the nature of the various cam tracks which are provided in the cam plates 92 and 93 of the L-shaped cam piece 90, and also to set forth the relative motions which obtain between such cam tracks and their respective follower rollers.

Considering first the cam plate 92 which has associated therewith the cam tracks CT1, CT2 and CT3 and their respective follower rollers FR1, FR2 and FR3, and referring particularly to FIGS. 10 and 20, it should be borne in mind that the follower rollers FR1 and FR2 are positionally fixed since they are carried at fixed positions on the centerpost 80. The cam piece 90, as previously described and as indicated by the double-ended arrows in FIGS. 10 and 20, is capable of up and down movement as well as transverse right and left movement. Therefore, the cam tracks CT1 and CT2 may be said to traverse the follower rollers FR1 and FR2 and the dotted lines which represent the paths followed by the follower rollers FR1 and FR2 represent relative motions of said rollers and the cam piece 90. On the other hand, the follower roller FR3 in the cam track CT3 is not positionally fixed. Rather, it is capable of right and left horizontal movement by reason of the lateral motion of which the slide member 116 (see FIG. 9) is capable. Further than this, however, the follower roller FR3 is incapable of vertical up and down movement or motion by reasons of the confinement of the slide member 116 in the horizontal groove 118.

Insofar as the cam track CT1 is concerned, this cam track embodies a lower vertical span 11, the previously mentioned offset 13, and an upper vertical span 15. In the medial region of the vertical span 15, there is provided an offset downwardly inclined ramp 17 which extends in the direction of the left side of the punch press and establishes a riser for conducting the following roller FR1 out of the cam track CT1 against the action of the associated spring 276 (see FIG. 9) and causing it to travel on the rear face of the cam plate 92 along the path indicated by the dotted line in FIG. 20.

Insofar as the cam track CT2 is concerned and as shown in FIG. 9, this track embodies a lower vertical span 19, the previously mentioned offset 21, a medial vertical span 23, a second offset 25, and an upper vertical span 27. At a region adjacent to the offset 21, there is provided a vertical ramp 29 which establishes a riser for conducting the follower roller FR2 out of the cam track CT2 against the action of its associated spring 276 and causing it to travel on the rear face of the cam plate 92 along the path indicated by the dotted line in FIG. 20.

Insofar as the cam track CT3 is concerned and with reference to FIGS. 10 through 14 and FIG. 20, this track embodies a lower vertical span 31, an offset 33, a second vertical span 35, a second offset 37, and a reentrant loop having left and right legs 39 and 41 (right and left with respect to FIGS. 10 through 15), the loop being in communication with the offset 37. A unidirectional gate member 290 (see particularly FIG. 16) which is integrally formed on a gate slide 292 and is confined within a recess 294 in the front wall or side of the U-shaped frame member 86, is biased by means of a helical compression spring 296 to a position wherein it blocks off the right leg (left-hand leg 41 with respect to FIGS. 10 through 15) of the reentrant loop from the offset 37 in a manner and for a purpose that will become readily apparent when the operation of the transfer mechanism 10 is set forth in connection with the timing chart of FIG. 22.

Considering now the second cam plate 94 which has associated therewith the cam track CT4 for the follower roller FR4 whose motion actuates the rocker arm 175 (see FIG. 7), and referring particularly to FIG. 21, the cam track CT4 embodies a relatively shorter lower vertical span 43 and an upper vertical span 45, the two spans being in communication with each other by means of a relatively wide offset 47 which presents a downwardly facing cam surface 49 and an opposing upwardly facing cam surface 51. During downward motion of the frame-like body 84 the follower roller FR4 rides against the cam surface 51 and during upward movement of said frame-like body 84 the roller FR4 rides against the cam surface 49. Since the follower roller FR4 serves to drive the crank arm 175 (see FIG. 3) and the rack bar 162 (see FIG. 4), the friction or drag liner 173 indirectly exerts a drag on the crank arm and causes the follower roller FR4 to hug closely the walls of the cam track CT4 during relative vertical motion between the cam track and said follower roller FR4. The left side face of the cam plate 94 is relieved as indicated at 299 and 300 to afford a clearance for movement of the rocker arm 175 on which the roller FR4 is mounted.

OPERATION OF THE TRANSFER MECHANISM

An understanding of the operation of the herein described transfer mechanism 10 may be greatly facilitated by reference to the timing chart or diagram of FIG. 22, wherein the positions of the principal components and of certain individual parts are graphically illustrated at various points in the punch press cycle. In discussing this diagram it is to be noted that the bracket-type line labelled "MAIN CAMS" indicates the up and down motions (excluding the right and left transverse motions) of the four cam tracks CT1, CT2, CT3 and CT4. This curve also represents the motion of the punch press crank 56 (see FIG. 1) which effects vertical reciprocation of the cam piece 90 and consequently the four aforementioned cam tracks which are formed in such cam piece.

It is also to be noted that for convenience of description a crank stroke of two inches has been ascribed to the crank 56 and the cam piece 90 and its associated cams, although other stroke distances are, of course, contemplated.

The bracket type line labelled "CLAMP" represents a 3/16 fore and aft displacement of the upper wedge member 192 in moving between the position it assumes in FIG. 7 and the position it assumes in FIG. 17, and also in moving between the position it assumes in FIG. 17 and the position it assumes in FIG. 19, such displacements taking place under the influence of the cam protuberances 220 and 222.

The bracket type line labelled "JAWS" refers to the clockwise and counterclockwise motion of the pinion 138 (see FIG. 19) under the influence of the rack 164, the crank arm 175 and the cam track CT4.

The bracket type line labelled "CRANK ANGLE" refers to the rotational position of the punch press crank 56 in progressive increments of 15° each.

Finally, it is to be noted that in all of the various views of the drawings, except as otherwise labelled, the positions of the parts illustrated are considered to be the positions which such parts assume at the commencement of the punch press cycle at the top of the ram stroke, namely, 0.0°.

Considering the transfer mechanism in the condition which it assumes at 0.0° in the punch press cycle, the crank 56 is in its up position and, therefore, the various cam tracks CT1, CT2, CT3 and CT4 which are formed in the cam piece 90 are fully elevated inasmuch as the punch holder 36 to which the cam piece is slidably attached is also elevated. The blank-engaging jaws are at this time locked in their closed position and serve to support a blank B at the second forming station FS2 as shown in FIGS. 3 and 4. The frame-like body 84 is in its extreme left position inasmuch as the follower rollers FR1 and FR2 are disposed, respectively, in the vertical spans 11 and 19 (see FIG. 20) of their associated cam tracks CT1 and CT2. The jaws J face to the left.

At approximately 7½° the frame-like body 84 commences its descent, carrying with it all of the movable parts of the transfer mechanism 10 and this downward motion of said body continues with no relative motion of movable parts until approximately 55° in the cycle at which time the follower roller FR3 (see FIG. 20) has traversed the offset 33 in the cam track CT3 and a period of dwell takes place where downward motion of the frame-like body 84 (which by this time has descended 0.2 inches) ceases. Immediately prior to this, and at approximately 45°, opening or unlocking of the jaws J begins by reason of the fact that the cam protuberance 222 on the downwardly moving cam piece engages the thrust link 248 (see FIG. 17) and causes the wedge member 192 to be shifted forwardly as previously described.

It should be borne in mind that the cam piece 90 is closely confined between the right and left side walls of the frame-like body 84 and, therefore, it must necessarily follow the right and left movements of such body. Therefore, the ½ inch right and left motions ascribed to the body 84, which is represented by the bracket type line labelled "BODY," also may be considered as the right and left motions of the cam piece 90 and, consequently, of the four main cam tracks CT1, CT2, CT3 and CT4. A half-inch vertical down motion ascribed to the body 84 takes place in two steps, the first step embodying a 0.2 inch drop and the second step embodying a 0.3 inch drop. The half-inch vertical up motion of the body 84 takes place in a single step.

At approximately 60° in the cycle full forward shifting of the wedge member 192 is completed so that the blank B is released from the jaws J aand deposited at the second forming station FS2 for whatever forming operation may be conducted at such station. Also at 60° in the cycle rightward motion of the frame-like body 84 commences due to the entry of the follower roller FR1 into the offset 13 of the cam track CT1. At this time, the follower roller FR2 has traversed the ramp 29 of the cam track CT2 and commences to follow the dotted line path alongside the offset 21 and the vertical span 23 (see FIG. 20).

At 75° in the cycle such rightward movement of the frame-like body 84 terminates, such body at this time having moved approximately ¼ inch. Also, at 75° in the cycle and with the jaws J now unlocked and in their open condition, counterclockwise rotation of the jaws J as viewed in FIG. 3 commences under the influence of the follower roller FR4 which has entered the wide offset 47 (see FIG. 21) of the cam track CT4 and encountered the cam surface 49, thereby causing the rocker arm 175 (see FIG. 7) to commence its forward swinging movement so as to force the rack 164 forwardly and rotate the pinion 137 in a counterclockwise direction.

This counterclockwise rotation of the jaws J continues until 135° in the cycle, during which time the frame-like body 84 dwells or remains stationary in its partially descended position and then, as soon as rotation of the jaws J is completed so that they face to the right, further downward movement of the body commences at 135° under the influence of the follower roller FR3 (see FIG. 20) which enters the right leg 39 of the reentrant loop of the cam track CT3 and this downward motion continues until approximately 180° in the cycle, at which time said frame-like body 84 has moved an additional 0.30 inches downwards and is now fully lowered so that it closely approaches the die shoe 32. The jaws J which now face to the right are at the level of a blank B issuing from the web W (see FIG. 3). At this time, the frame-like body 84 has moved downwardly a total distance of ½ inch. The open jaws J now oppose the leading edge portion of the new blank at the forming station FS1.

At approximately 180° in the press cycle, the crank 56 of the punch press 12 is fully down while the frame-like body 84 which already has been displaced to the right by ¼ inch commences a second rightward displacement of another ¼ inch under the influence of the follower roller FR2 which enters the offset 25 of the cam track CT2. At this time, the follower roller FR1 encounters the ramp 17 and thus leaves the cam track CT1 and follows the dotted line path alongside the vertical span 15 of said cam track CT1.

At 225° in the press cycle, the frame-like body 84 has completed its second motion to the right and has moved a total of ½ inch to the right in order to shift the open jaws J into straddling relationship with the blank B at the forming station FS1. At this point, the cam protuberance 220 on the cam piece 90, which at this time is moving upwardly, engages the thrust link 246 as shown in FIG. 19 and thus causes the wedge member 192 to be shifted forwardly thereby resulting in the jaws J becoming locked in engagement with the leading edge portion of the blank B as previously described.

At 240° in the cycle, the jaws J are locked to the blank B and the frame-like body 84, together with the closed jaws J, begin to rise so as to lift the blank B out of the plane of the web W.

At 270° in the cycle, the frame-like body 84, the jaws J, and the blank B carried thereby, all of which are now fully elevated ½ inch, commence to rotate bodily in a clockwise direction and, while effecting such rotation and at 285° in the cycle, there commences restoration of said frame-like body 84 to its initial position to the left throughout the full distance of ½ inch. During such restoration of the frame-like body 84, the follower roller FR2 traverses the offset 21 of the cam track CT2 while the cam piece 90 is moving upwards in unison with the punch press crank 56.

At 345° in the cycle, the frame-like body 84 and the jaws J together with the blank B carried by the latter have shifted completely to the left while the jaws J have not quite completed their 180° rotation. However, at 360° such rotation is complete and the various parts are restored to the positions which they assumed at the commencement of the cycle.

In the interests of brevity, inasmuch as throughout the foregoing description of the operation of the present transfer mechanism 10, the relative movements between the cam tracks CT1, CT2 and CT3 and their respective follower rollers FR1, FR2 and FR3 have been fully set forth and, in view of the previous description of the manner in which such follower rollers function to effect direct raising and lowering of the cam piece 90, right and left shifting of such cam piece, indirect raising and lowering of the frame-like body 84, and indirect right and left shifting of such body, it has not been deemed necessary to trace the ultimate function which results each time a relative cam track and follower roller motion is mentioned. For example, where it has been pointed out that a particular increment of horizontal movement of the cam track CT3 with respect to its associated follower roller FR3 has been effected and that this has resulted in a corresponding vertical shifting of the frame-like body 84, a previously rendered description should make it apparent that such vertical shifting of said body 84 is a result of the horizontal movement of the slide member 116 (see FIG. 9) and a consequent camming action between the cam surface 120 and the follower roller 121, such camming action serving to shift the slide member 122 vertically. Vertical movement of the slide member 122 serves to carry the back plate 88 of the frame-like body 84 vertically with respect to the fixed centerpost 80 on which it is slidable, the vertically extending springs 262 serving to bias the slide member 122 downwardly and the horizontally extending springs 280 serving to bias the slide member 116 to the left so that the follower roller FR3 will traverse the extreme upper end of the reentrant loop 39 of the cam track CT3 from one side of the loop to the other.

The present invention is not to be limited to the exact arrangement of parts shown in the accompanying drawings or described in this specification as various changes in the details of construction may be resorted to without departing from the spirit or scope of the invention. For example, the specific dimensions expressed in inches for the vertical and horizontal displacements of the frame-like body 84 under the influence of the various cam tracks and their associated follower rollers were selected as convenient dimensions for descriptive purposes and other dimensions are contemplated within the scope of the invention. Furthermore, although the present transfer mechanism 10 has been shown and described herein as being operatively installed in a punch press of the open back inclinable type, such punch press constitutes merely one which is well-adapted for descriptive environmental purposes and, if desired, the present transfer mechanism may, with or without modification as required, be operatively associated with a wide variety of other types of punch presses. Therefore, only insofar as the invention is particularly pointed out in the accompanying claims is the same to be limited.

Having thus described the invention what I claim as new and desire to secure by Letters Patent is:

1. The combination with a punch press having a fixed die shoe and a vertically reciprocable punch holder, of a cyclicly-operable transfer mechanism for receiving successive work blanks issuing from a web at a first forming station and delivering the same angularly displaced to a second forming station, said transfer mechanism comprising a guide member fixedly secured to the die shoe, a carriage shiftable laterally on said guide member between said stations, a pair of work-engaging jaws mounted on said carriage for rotation about a vertical axis and including cooperating jaw fingers relatively movable toward and away from each other between blank-gripping and blank-releasing positions, means for releasably locking said jaw fingers in their blank-gripping position, a cam member shiftable laterally in unison with said carriage and slidably secured to the punch holder for vertical movements in unison therewith, means effective between said carriage and jaws for rotating the latter, first cam means effective between the cam guide members for shifting the cam member and consequently the carriage laterally, second cam means effective between the cam member and rotating means for actuating the latter, and third cam means effective between the cam member and jaws for actuating said locking means.

2. The combination set forth in claim 1 and wherein the means for rotating the jaws comprise a rack and a pinion.

3. The combination set forth in claim 2 and wherein the pinion of the jaw-rotating means is rotatable bodily in unison with said jaws, the rack of said rotating means is slidable on said carriage, and the second cam means embodies a rocker arm pivoted at one end to the carriage for swinging movement about a horizontal axis, a pin and slot connection between the other end of the rocker arm and rack, a cam track on said cam member, and a cooperating cam follower on said rocker arm.

4. The combination set forth in claim 3 and wherein said pin and slot connection embodies a slot in said other end of the rocker arm, and a pin mounted on said rack for limited adjustment radially of said rocker arm whereby adjustment of the pin serves to vary the effective length of the rocker arm and consequently the extent of movement of said rack to thus vary the extent of angular displacement of the blank-engaging jaws.

5. The combination set forth in claim 3 and wherein the means for releasably locking the fingers in their work-gripping position includes a pusher member slidable on said carriage between a retracted position and an advanced position, and wedge means is effective when said pusher member is in its advanced position for locking said jaws in their blank-gripping position, and said third cam means is effective to actuate said pusher member.

6. The combination set forth in claim 2 and wherein said rack and pinion means is effective to rotate the jaws from an initial angular position at the first forming station through an angle of 180° to reverse the same at the second forming station, whereby each work blank is delivered to the second forming station in a terminal angular position which is reversed end to end from its initial position at the first forming station, the means for releasably locking said fingers in their work-gripping position includes a pusher member slidable on the carriage between a retracted position and an advanced position, the wedge means is effective when the pusher member is in its advanced position and the jaws are in their initial position for locking the jaws in their blank-gripping position, and the third cam means is effective to actuate said pusher member.

7. The combination set forth in claim 6 and wherein said wedge means is effective when the pusher member is in its advanced position and the jaws are reversed to release said jaws from their work-gripping position.

8. The combination with a punch press having a fixed die shoe and a vertically reciprocable punch holder, of a cyclicly-operable transfer mechanism for receiving successive work blanks issuing from a web at a first forming station and delivering the same in an angularly reversed position to a second forming station which is laterally removed from the first station, said transfer mechanism comprising a guide member fixedly secured to the die shoe, a carriage shiftable laterally and vertically on said guide member, a pair of blank-engaging jaws mounted on the carriage for rotation about a vertical axis and including cooperating jaw fingers relatively movable toward and away from each other between blank-gripping and blank-releasing positions, means for releasably locking said fingers in their blank-gripping position, a cam member shiftable laterally in unison with said carriage and slidably secured to the punch holder for vertical movements in unison therewith, means effective between said carriage and jaws for rotating the latter, first cam means effective between the cam member and the guide member for shifting the cam member and consequently the carriage laterally, second cam means effective between the cam member and guide member and also between the guide member and carriage for shifting the carriage vertically, third cam means effective between the cam member and jaw-rotating means for actuating the latter, and fourth cam means effective between said cam member and jaws for actuating said locking means.

9. The combination set forth in claim 8 and wherein the jaw-rotating means comprises a pinion rotatable bodily in unison with said jaws and a cooperating rack slidable on said carriage, and the third cam means embodies a rocker arm pivoted at one end to the carriage for swinging movement about a horizontal axis, a pin and slot connection between the other end of the rocker arm and rack, a cam track on said cam member, and a cooperating cam follower on said rocker arm.

10. The combination set forth in claim 9 and wherein said pin and slot connection embodies a slot in said other end of the rocker arm, a pin mounted on the rack for limited adjustment radially of said rocker arm whereby adjustment of the pin serves to vary the effective length of the rocker arm and consequently the extent of movement of said rack to thus vary the extent of angular displacement of the blank-engaging jaws.

11. The combination set forth in claim 9 and wherein the means for releasably locking the fingers in their blank-gripping position includes a pusher member slidable on the carriage between a retracted position and an advanced position, and wedge means is effective when said pusher member is in its advanced position for locking the jaws in their blank-gripping position, and the fourth cam means is effective to actuate said pusher member.

12. The combination with a punch press having a fixed die shoe and a vertically reciprocable punch holder, of a cyclicly-operable transfer mechanism for withdrawing blanks successively from a laterally extending web at a first forming station and delivering the same in end-to-end reversed positions at a second forming station leftwardly removed from the first forming station, said transfer mechanism comprising a rectangular block-like centerpost fixedly secured to the die shoe between said stations and presenting front, rear, right and left side faces, a generally rectangular open loop-like carriage encompassing said centerpost and shiftable thereon both vertically and laterally, said carriage having front and rear walls and right and left side walls and including a forwardly extending rectilinear loop-like extension, a pair of blank-engaging jaws mounted on the forward end of said extension for rotation about a vertical axis through an angle of 180° and relatively movable toward and away from each other between a closed blank-gripping and an open blank-releasing position, means for releasably locking said jaws in their closed position, an L-shaped cam plate also encompassed by said carriage, having a lateral leg bridging the distance between the right and left carriage side walls and having a rearwardly extending leg bridging the distance between the carriage front and rear walls whereby the cam plate is constrained to shift laterally in unison with the carriage, means securing the upper end of said cam plate to said punch holder for lateral sliding movement thereon and also for vertical shifting movement in unison therewith, rack and pinion means effectively between the carriage and jaws for rotating the latter, first cam means effective between the lateral leg of the cam plate and centerpost for shifting the cam plate, and consequently the carriage laterally, second cam means effective between the lateral leg of the cam plate and centerpost, and also between the centerpost and carriage, for shifting the carriage vertically, third cam means effective between the rearwardly extending leg of the cam plate and rack and pinion means for actuating the latter, and fourth cam means effective between the cam member and jaws for actuating said locking means.

13. The combination set forth in claim 12 and wherein said rack and pinion means comprises a pinion rotatably mounted on the forward end of the extension and drivingly connected to the jaws, and a cooperating rack slidable on said extension, and the third cam means embodies a rocker arm pivoted at one end to the left side wall of the carriage for swinging movement about a horizontal axis, a pin and slot connection between the other end of the rocker arm and rack, a cam track on said rearwardly extending leg of the cam plate, and a cooperating cam follower on the outer end of said rocker arm.

14. The combination set forth in claim 13 and wherein the pin and slot connection embodies a slot in the other end of the rocker arm, a pin mounted on said rack for limited adjustment radially of said rocker arm whereby adjustment of the pin serves to vary the effective length of the rocker arm and consequently the extent of movement of said rack to thus vary the angular extent of displacement of said pinion.

15. The combination set forth in claim 13 and wherein the means for releasably locking the jaws in their work-gripping position includes a pusher member slidable on said carriage between a retracted position and an advanced position, wedge means is effective when said pusher member is in its advanced position for locking said jaws in their blank-gripping position, and the fourth cam means is effective to actuate said pusher member.

16. The combination set forth in claim 8 and wherein the second cam means embodies a cam track on said cam member, a first slide member on said guide member and having a cooperating follower roller thereon, a cam surface on said first slide member, and a second slide member on said carriage and having a follower roller thereon cooperating with said cam surface.

17. The combination set forth in claim 12 and wherein a second cam means for shifting the carriage vertically embodies a cam track on the lateral leg of said L-shaped cam plate, a first slide member on said centerpost and having a follower roller thereon cooperating with said cam track, a cam surface on said first slide member, and a second slide member on said carriage and having a follower roller thereon cooperating with said cam surface.

18. The combination set forth in claim 12 and wherein the second cam means for shifting the carriage vertically embodies a cam track on the lateral leg of said L-shaped cam plate, a first slide member disposed in a horizontal groove formed in the front side face of said centerpost, a follower roller on said first slide member and cooperating with said cam track, a cam surface on said first slide member, and a second slide member disposed in a horizontal groove formed in the rear wall of said carriage and having a follower roller thereon cooperating with said cam surface.

19. The combination set forth in claim 18 and wherein said second slide member is slidable in a vertical slot in the rear side of said centerpost.

20. The combination set forth in claim 19 and including, additionally, spring means yieldingly biasing said first slide member leftwardly, and spring means yieldingly biasing said second slide member downwardly.

21. The combination set forth in claim 12 and wherein the first cam means for shifting the cam plate and carriage laterally embodies a pair of cam tracks on the lateral leg of said cam plate and a pair of cooperating follower rollers on said centerpost, said second cam means for shifting the carriage vertically embodies a cam track on the lateral leg of said L-shaped cam plate, a first slide member on said centerpost and having a follower roller thereon cooperating with said cam track, a cam surface on said first slide member, and a second slide member on said carriage and having a follower roller thereon cooperating with said cam surface, the rack and pinion means comprises a pinion rotatable bodily in unison with said jaws, and a cooperating rack slidable on said carriage, the third cam means for actuating the rack and pinion means embodies a rocker arm pivoted at one end to the front wall of the carriage for swinging movement about a horizontal axis, a pin and slot connection between the other end of the rocker arm and rack, a cam track on the rearwardly extending leg of the cam plate, and a cooperating cam follower on said rocker arm, and the means for releasably locking the jaws in their blank-gripping position comprises a pusher member slidable on said carriage between a retracted position and an advanced position, and wedge means is effective when said pusher member is in its advanced position for locking the jaws in their blank-gripping position, and the fourth cam means is effective to actuate said pusher member.

22. The combination set forth in claim 1 and wherein the first cam means for shifting the cam member and carriage laterally and the second cam means for actuating the jaw-rotating means are operable in unison, whereby rotation of the jaws takes place during lateral motion of the carriage between said first and second forming station.

23. The combination set forth in claim 8 wherein the first cam means for shifting the cam member and carriage laterally and the third cam means for actuating the jaw-rotating means are operable in unison, whereby rotation of the jaws takes place during lateral motion of the carriage between said first and second forming stations.

24. The combination set forth in claim 8 and wherein the first cam means for shifting the cam member and carriage laterally, the second cam means for shifting the carriage vertically, and the third cam means for actuating the jaw-rotating means are operable in unison whereby rotation of the jaws, vertical carriage movement and lateral carriage movement takes place simultaneously.

25. The combination set forth in claim 12 and wherein the first cam means for shifting the cam plate and carriage laterally and the third cam means for actuating the rack and pinion means to rotate the jaws are operable in unison whereby rotation of the jaws takes place during lateral motion of the carriage between said first and second forming stations.

26. The combinations set forth in claim 12 and wherein the first cam means for shifting the cam plate and carriage laterally, the second cam means for shifting the carriage vertically, and the third cam means for actuating the rack and pinion means to rotate the jaws are operable in unison whereby rotation of the jaws, vertical carriage movement and lateral carriage movement take place simultaneously.

* * * * *